US006945338B1

(12) United States Patent
Defourny et al.

(10) Patent No.: US 6,945,338 B1
(45) Date of Patent: Sep. 20, 2005

(54) DRILLING BIT ASSEMBLY AND APPARATUS

(75) Inventors: Paul M. Defourny, Bois du Breucq (BE); Fereidoun Abbassian, Houston, TX (US)

(73) Assignee: Baroid Technology, Inc., Houston, TX (US)

( * ) Notice: Subject to any disclaimer, the term of this patent is extended or adjusted under 35 U.S.C. 154(b) by 835 days.

(21) Appl. No.: 08/696,986

(22) PCT Filed: Jan. 30, 1995

(86) PCT No.: PCT/GB95/00181

§ 371 (c)(1),
(2), (4) Date: Mar. 3, 1997

(87) PCT Pub. No.: WO95/21317

PCT Pub. Date: Aug. 10, 1995

(30) Foreign Application Priority Data

Feb. 4, 1994 (GB) ..... 9402216

(51) Int. Cl.[7] ..... E21B 4/00

(52) U.S. Cl. ..... 175/106; 175/101; 464/18; 464/20

(58) Field of Search ..... 175/106, 101; 464/18, 19, 20, 21

(56) References Cited

U.S. PATENT DOCUMENTS

| | | | | | |
|---|---|---|---|---|---|
| 2,740,651 | A | * | 4/1956 | Ortloff | 175/321 |
| 3,135,103 | A | * | 6/1964 | Black | 464/20 |
| 4,261,425 | A | * | 4/1981 | Bodine | 175/106 |
| 4,904,228 | A | * | 2/1990 | Frear et al. | 464/152 |
| 5,836,407 | A | * | 11/1998 | Leroy | 175/101 |

FOREIGN PATENT DOCUMENTS

DE 4123639 A1 * 1/1993

* cited by examiner

*Primary Examiner*—Jong-Suk (James) Lee
(74) *Attorney, Agent, or Firm*—Carlos A. Torres; Browning Bushman, PC

(57) ABSTRACT

A drill bit comprises a shank member (31), a bit body (32) provided with cutters (33) and flexible material (35) between the shank (31) and the bit body (32) allowing relative tilting movement therebetween to reduce adverse effects caused by vibration of the bit. In other embodiments, flexible material is provided between the bit body and the cutters. In further embodiments, the flexible material may be provided in a tiltable sub-assembly for incorporation in a drilling above the drill bit. An apparatus for simulating drilling conditions is also provided.

29 Claims, 19 Drawing Sheets

FIG. 17
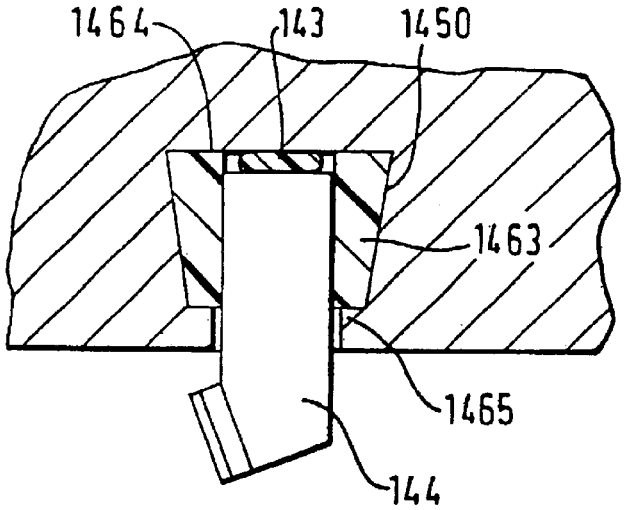
FIG. 18
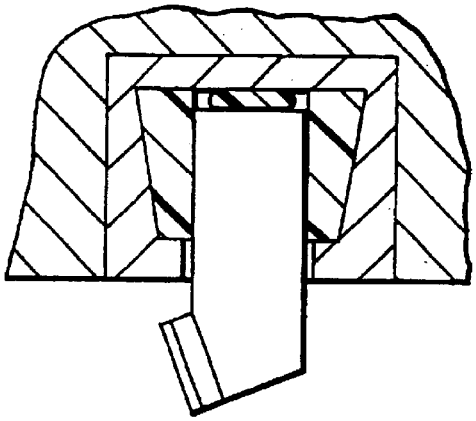
FIG. 19A
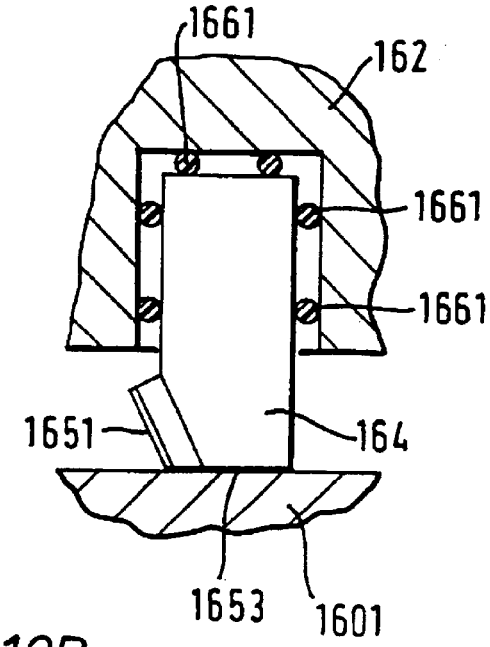
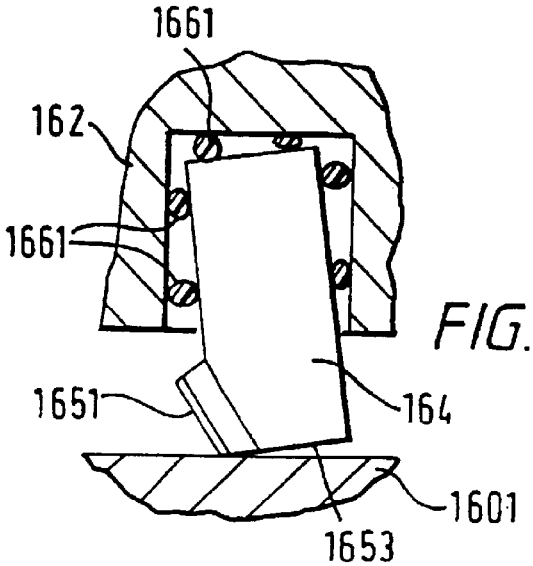
FIG. 19B

DRILLING BIT ASSEMBLY AND APPARATUS

BACKGROUND OF THE INVENTION

1. Field of the Invention

This invention concerns drill bit assemblies for drilling, coring or removing material from a geological subsurface formation.

2. Description of Related Art

Such drill bits have cutters which are either rigidly mounted on the bit body or on an extension of that body, e.g., blades or studs in the body, or may be mounted on roller cones which can rotate around axles rigidly fixed to the bit body. On the side of the drill bit usually distant from the cutters, such drill bits have a connector, usually threaded, which allows a rigid connection to be made between the bit and the bottom hole assembly and hence the drill string. In use the bit rotates and moves up and down. Eventually the bit is worn out or prematurely broken.

The replacement of a bit involves high cost in lost time as well as the cost of the new physical equipment. The problem of breakage of bits is thus very important in the drilling industry.

In relation to diamond faced bits for cutting or scraping such as diamond faced studs or faces, especially polydiamond crystal (PDC) wafer facing, the cutter comprising the diamond facing may become prematurely broken or dislodged. One reason for the breakage of PDC bits is that caused by vibration of the bit on the end of the very long drill pipe, the vibration resulting e.g. from interaction of the bit and the formation, or of the drill string and the well bore, and causing motion of the bit, which is not concentric nor at uniform speed, e.g. causing slip-stick, bit whirl and bit bounce.

Antiwhirl bits have been described and used in which the cutters are not uniformly distributed around the bit; in at least one place instead of a cutter there is a frictionless pad, the effect of which is that on contact of it and the rock, the bit slides over the rock surface instead of gearing with it. Although antiwhirl bits have in some cases enabled PDC bits to drill into harder formations, they have been less successful in highly interbedded formations, e.g. when drilling through rocks of variable or different hardness, which results in vibration of the bit. This problem is especially acute with exploratory wells where the nature of the rocks and the location of their interfaces is not accurately known. Because the cutters are in contact with different rocks, the resultant side force on the bit can no longer be maintained within the low friction pads so the low friction pads of the antiwhirl devices lose their effectiveness. There is thus vibration, an eccentric hole and breakage/dislocation of the cutter.

It is known to provide drill strings for driving drill bits having rotary drive transmitting sections which can be moved relative to one another from an axially aligned disposition in order to allow entering and drilling horizontal well sections, through a short radii curved hole, that would require excessive bending of a conventional stiff drill string. This may be achieved for example by providing hinged driving joints between the two sections or between the lower end of the drill string and the drill bit, or by providing wall sections which can be readily deformed to accommodate angular changes in the drilling direction. As the purpose of those devices is to cope with an important hole curvature, the drill bit itself is left rigid, in accordance with conventional bit designs.

EP-A-0,225,101 is concerned with reducing the problem of overheating of drill bits caused by excessive weight-on-bit during drilling or by sudden overload. This is achieved by a bit body having at least two relatively movable structures each carrying cutting elements, the two structures being relatively movable between two limiting positions to allow a change in configuration of the bit to be effected when required. In some embodiments resilient means may be provided to oppose relative movement of the structures in an axial and/or rotational direction. However there is no teaching or suggestion in this specification of providing any means for allowing tilting or relative lateral movement of the two relatively moveable structures of the drill bit assembly of EP-A-0,225,101.

SUMMARY OF THE INVENTION

A first object of the invention is to provide means incorporated in, or for incorporation in, a drill bit itself to enable the drill bit to operate in a dynamically more stable manner and to be used to drill a less eccentric hole for a longer period without breakage or dislocation of the cutter, or breakage to the bit itself.

Another object of the invention is to provide an improved sub-assembly for use in a rotary drive system for a drill bit, which also enables a dynamically more stable operation of the drill bit.

A further object of the invention is to provide an apparatus for simulating drilling to determine optimum drilling parameters.

The present invention provides apparatus for a drill bit which is suitable for use in drilling, coring or removing material from a geological subsurface formation, which apparatus comprises a first member for attachment directly or indirectly to a drill string and a second member carrying or constituting at least one means for drilling, said first member being in torque and weight transmitting relation with said second member, characterized by means allowing tilting of or lateral movement of said first member relative to said second member. The invention also includes a method of drilling, coring or removing material from a geological subsurface formation using a drill bit assembly incorporating such apparatus.

In some embodiments the apparatus may be in the form of a sub-assembly for incorporation within said drill bit.

In other embodiments, the first member may constitute the shank of the drill bit, and said second member may carry at least one means for drilling.

The means for allowing relative tilting or lateral movement of the first and second members may comprise elastically or resiliently deformable means and may allow such relative movements freely in all directions.

In some constructions according to the invention there may be provided means for holding said first and second members together and for transferring torque and weight from said first to said second member.

The first member and second member may be of any cross section e.g. square, rectangular, hexagonal or other polygonal, but are preferably rounded such as elliptical but are especially of substantially circular cross section. The members may be of 13–762 mm (0.5–30 inch) e.g. 102–445 mm (4–17.5 inch) diameter. The first member may be the part of the bit which is to be joined to the bottom hole assembly, and hence to the drill string; the join to the bottom hole assembly may be direct or via a motor. The join is preferably via threads on the first member and bottom hole assembly, especially male threads on the first member engaging with a threaded recess in the bottom hole assembly. The first and second member are usually of metal such as steel, or brazing alloys, or of tungsten carbide and may be of lighter or heavier gauge than the drill pipe, which connects it to the rotation means at the drilling rig. Each of the first and second members may be solid, but is usually hollow or has a passage parallel to or along its longitudinal axis; especially both have a passage which cooperates to allow flow of drilling fluid from the drill pipe through said members towards the drill means, and, especially the second member, may incorporate one or more surface holes or nozzles for ejecting this fluid.

The second member may be of the same steel or other ferrous metal as the first member, or may be of matrix material and may have been moulded directly to the desired shape. The second member may carry the drill means. The bit profile may be rectangular, e.g. flat, or curved, e.g. hemispherical or single- or double-parabolic.

The second member may be the part of the bit on which the drill means is mounted. The drill means may be a means for compression fracturing of the material to be drilled and/or scraping, abrading or cutting that material. Among suitable drill means are roller cones and cutters such as PDC wafers; for convenience the drill means will hereafter be exemplified by a cutter, though similar approaches apply with other drill means (unless otherwise stated). The cutters may be arranged uniformly or non uniformly on the surface of that member distant from the side near said first member. The said side of the second member, on which the cutter(s) are mounted, may be convex rather than concave, or may be protrusions of this second member. The said protrusions may be an integral part of the said second member, in which case they will usually resemble blades, or they may be rotatable roller cones. The said protrusions may be disposed radially and straight, or radial and curved in plan view or in other dispositions. Each cutter or contact point of the drill means is preferably made of hard material, e.g. tungsten carbide or tungsten carbide reinforced with diamond or PDC wafer; the wafer may be up to 3 mm, e.g. 0.5–2.5 mm thick, while a stud carrying the wafer supported by the hard material may be of 10–50 mm, such as 15–25 mm diameter. The said cutter or contact point may be directly or indirectly (using a stud), rigidly or flexibly mounted on the said surface of the second member. When a stud is used, it may be of tungsten carbide as commonly used. The outer wafer edge is the cutter edge and may extend along all of one side of the stud. When one of the cutter orientations needs to be maintained, a keying device which secures only that orientation can be present or the stud can be pre-shaped such that this orientation will be secured, e.g. with an elliptical cross section.

The first member is rotated by the drillpipe and in turn rotates the second member, the torque being transmitted from the first to second member. The same component of the assembly may provide both the holding and the torque transmission means, or separate components may be used for each of these means. Thus this component of the assembly may lock the first to the second member, against relative movement in any direction and therefore provide the holding means, and also provide the torque transfer means while allowing tilting of the cutter with respect to second member; in this form, the first and second members may if desired be integral. Alternatively this component of the assembly may lock the first and second member against relative movement in the axial direction but allow relative movement in an angular (i.e. twisting) direction in which case a separate torque transmission means is required. The holding means keeps the first and second members together and usually transmits the weight from the drill string to the second member, to provide the weight on bit (WOB). The transmission means may comprise at least one elongate member, e.g. a pin or bolt extending through said second member to engage at least one groove or slot in said first member; if desired the locations of the pin and groove/slot in the first and second members may be reversed. The transmission means may also comprise a cooperating pair of a radial extension or extensions, e.g. star or gear shaped, and a corresponding groove(s) or recess(es), one on each of the first and second members. In the case of this cooperating pair, the first and second members are preferably held together with the aid of a threaded locking ring, which engages threads on the second member, e.g internally facing threads, and bears against or towards at least one corresponding projection or outwardly extending ridge on said first member. Other corresponding pairs of interacting components on the first and second members may be used, e.g. other cranked or polygonally shaped components and recesses to provide the torque transmission means.

The means allowing tilting may be in relation to the first and second members, with the drill means fixed relative to the latter, and in this case the drill means may be cutters or roller cones; preferably the means allowing tilting is between said first and second members. The means allowing tilting may be in relation to the second member and the cutter, with the first member fixed relative to the former and in this case the drill means are preferably cutters and not roller cones; preferably the means allowing tilting is between said second member and cutters. The means allowing tilting may also be between all three, i.e. between first and second members and the cutter. The angle of tilt may be up to 15°, such as 1–15°, preferably 4–10°.

The extent of possible tilting between the first and second member, or second member and cutter, may be until they come into contact with each other thereby restricting further tilting, but preferably further tilting before contact is restricted by a tilt restriction means. The latter may allow some free tilting when the assembly is at rest (when no load is applied), as well as when it is in use, but preferably the tilt restriction means is a medium which provides some stiffness (resistance) against tilting movement, the stiffness being less than that of the first or second member.

The first and second member, or the second member and cutter, may be capable of small lateral or transverse movement relative to one another, e.g. lateral movement of first and second members of less than five hundredth of the bit diameter. Thus the rotating axis of the second member may be capable of lateral movement relative to that of the first member, as well as or instead of the capacity for tilting movement when the first and second members are tiltable. Some axial movement of the first and second members may also occur, but only in association with lateral or tilting movement. The present specification describes further the tiltability features and the assemblies suitable for providing it, but the same general principles apply as well to the lateral movement feature; preferably the means allowing tilting is present in the assembly of the invention with means allowing lateral movement optionally present.

In some embodiments of the invention, the second member may be tiltable with respect to said first member to allow relative pivotal movement, but not axial movement. The first and second members are spaced apart but held together, though preferably the degree of tilt is restricted by tilt restricting means, which is preferably present in the space between the members. The tilt restricting means may be at least one elastomeric spacer, e.g. of uniform or non uniform thickness such as at least 0.2 mm or 0.3 mm or 1 mm thick, such as 0.2–5 mm or 1–3 mm thick restricting tilt and 0–0.5 mm, e.g. 0.1–0.3 mm thick restricting torque. Increasing bit diameters allows thicker tilt restriction means, e.g. up to 10 mm.

The spacer is usually such that the first member can tilt relative to the second member against the resistance of the elastomeric spacer. This approach in general applies whatever the nature of the torque transfer means, e.g. as described above. The spacer may extend axially (i.e. parallel to the longitudinal axis of the bit) when the torque transfer means comprises also the means for holding the first and second members together, but may extend radially (i.e. normal to the longitudinal axis of the bit) when the torque transfer means does not so hold said members, e.g. when a locking ring is also needed, as described above; preferably the spacer extends both axially and radially. When the tilt restricting means allows tilt under no applied load, there is still a gap between the spacer and at least one of the members. However said means preferably allows substantially no tilt at rest so the spacer contacts both members, but allows freedom to tilt when the assembly is in use, e.g. because of the compressibility of the spacer, so the two members are pivotally movable in use under applied load.

The first and second members may each have an elongate conduit through it, the two conduits cooperating to allow flow of drilling fluid; if it is desired not to allow any leakage of said fluid through said gap between the members, then preferably a flexible pipe, e.g. a reinforced pipe of plastic materials extends through said conduits to provide the desired fluid passage. Otherwise the gap may comprise sealing means, which may also be the elastomeric spacer.

In other embodiments of the invention, at least one cutter constituting said second member, and especially all said cutters may be tiltable with respect to said first member, e.g. constituted by the drill bit. The cutter may be adhered to the first member with an elastomer which also provides the spacer. The cutter may be mounted on a stud which is in a hole or socket in said first member, and adhered thereto with a layer of adhesive to restrain the stud from removal of the hole or socket and provide the facility for tilting; other restraining means may be used. Such restraining means include cooperating combinations of grooves and ridges or projections or other bearing surfaces in the stud and hole/socket, with optional assistance of at least one ball and or spring, or an elastomeric stud catcher or the hole or socket may be of outwardly decreasing cross section (especially in combination with the stud catcher). In relation to use of the other restraining means, there may also be at least one elastomeric spacer, e.g. an O-ring, which may be friction fitted on the stud or in the hole or socket or at least partly received in grooves in the stud or hole or socket. If desired the hole or socket may not have been formed e.g. by drilling in the first member, but may be formed e.g. by moulding a matrix material to form a sleeve for insertion into a preformed hole in the first member; the spacer may then be placed in the hole/socket with the stud and the entire body (i.e. the sleeve with spacer and stud) then inserted into the first member.

The spacer may be elastomeric. It may be formed in situ from a liquid settable material which cures to an elastomer, such as an epoxy or polyurethane resin. The components of the assembly on either side of the intended spacer may be joined together mechanically, or placed in the desired place relative to one another and then the liquid poured into place, with the optional aid as desired of a plug for a central passage in the first and second member and/or a ledge or trough outside the two members to aid transfer of the liquid into the space between the two members. In the case of the cutter, the liquid may be poured into the hole or socket and then the cutter or stud carrying the cutter inserted into the uncured material. The liquid may be inserted at atmospheric pressure, or higher or lower pressure, in order to obtain a prestressed stage for the joint, to increase its strength for the high loading. The liquid polymerizes at room temperature, or higher if desired or necessary, to form an elastomer, usually one of compression modulus, which is up to 1000 times e.g. 100–1000 times lower than that of the material of the bit body, and may be $0.1–10\times10^9$ $Nm^{-2}$.

More than one elastomer may be used in different places in the spacer if desired, especially ones with different properties e.g. different moduli or adhesive/sealing characteristics; in this case the liquids would be poured and set in situ sequentially.

The elastomer may also be preshaped, especially for use in the space between the first and second members, or for example as stud catcher. The preshaped bodies may be as rings or squares or gaskets, or other bodies of complex geometry. Preferably for use with the studs, they are in the form of O-rings. The preshaped elastomeric material may be unfilled or filled with a solid additive e.g. alumina, and may be of the same compression modulus range as described above. Examples are epoxy resin, natural rubber, tetrafluorethylene polymers e.g. "TEFLON" polymers, "ERTALON", polyurethane and rubber elastomers such as styrene butadiene and neoprene rubbers as well as hydrogenated nitrile or standard nitrile rubbers. Use of the preformed shaped elastomeric spacers reduces the construction time by avoiding the time for polymerization and also allows for maintenance, repair or reuse of the spacer.

Preferably the elastomer has a Shore A hardness of at least 80 to reduce extrusion under load and a compression modulus which is 0.1 or less e.g. 0.01 or less such as 0.001–0.1 of that of steel.

The elastomer may be used as such as the spacer, or may be in the form of a layered body with at least one elastomer layer, e.g. 1–4 layers, and at least one metal layer e.g. 2–5 layers; the layers may be bonded together if desired. In the case of gaskets or other preshaped bodies, the elastomer may be restrained from extrusion by a metal frame.

Instead of an elastomeric spacer allowing restriction of tilt in the assembly, there may be used other materials for achieving that purpose, such as preshaped springs such as helical springs under compression, belleville springs or hollow springs or springs combined with a damper. Another form of the tilt restriction mechanism can involve a hollow elastic body e.g. a hollow cylinder such as a toroidal metallic body, or can involve a body e.g. an elastic body adapted to contain a compressible fluid, e.g. a gas such as air or an inert gas. The deflated body may be inserted at least partly in the space between the first and second members (or second member and cutter) and then may be filled with the fluid, e.g. inflated. If desired, the body may extend into grooves or recesses in one or both of the first and second bodies. The body may be in the form of a band, e.g. of reinforced rubber like a tyre or in the form of a tube, e.g. a torus. The inflation may be to a set pressure, or the pressure may be modifiable, e.g. to increase if the load increases either automatically or following instruction by an operator; pressure control means capable of achieving this are well known in the literature on downhole pressure control engineering. If the torque is low, and the pressure in the inflated body high then that body may act itself as the torque transmission means as well as the tilt restricting means.

The assemblies of the invention may be dynamically more stable than known bits without the tilting means, can rotate more smoothly and uniformly and have an increased lifetime due to reduction in the frequency of damage or dislocation of the cutters, especially when moving between formations of different or variable hardness.

The invention also provides a sub-assembly for incorporation in a drill string, said sub-assembly comprising a first member and a second member each for torque transmitting attachment to respective elements of the drill string to provide a rotary drive connection between those elements of the drill string, means for transmitting weight and torque between the first and second members, and means for allowing tilting or lateral movement of said first member relative to said second member freely in any direction.

The invention further includes an apparatus for simulating drilling which comprises (a) at least one rigid rotatable body connected directly or indirectly to (b) a drill bit for contacting a simulated bottom hole surface, and (c) means for rotating said body and bit, wherein at least one of (a) and (b), and (a) and (c), is separated by a flexible connector. The invention further includes a method of simulating downhole drilling conditions of a specific downhole location utilizing such an apparatus, including testing scale versions of downhole equipment to be used at the downhole location in the apparatus and altering the design of the equipment as necessary in order to reach an optimized design of such equipment, and using the optimized design for the corresponding equipment to be used in practice at the downhole location. The invention further includes a method of simulating downhole drilling conditions of a specific downhole location utilizing such an apparatus.

The present invention is illustrated in the accompanying drawings in which:

BRIEF DESCRIPTION OF THE DRAWINGS

FIG. 6B is a cross-sectional view taken along the line VI—VI of FIG. 6A.

FIG. 6B is a partial sectional view, and FIGS. 7B and 7C are enlarged partial sectional views; FIG. 7C is a variation of the section illustrated in FIG. 7B; FIG. 7B is a cross-section taken along the line VII—VII of FIG. 7A;

FIGS. 14–20 represent sketches showing schematically dispositions of cutters on studs in holes in the second members for use in drill bits according to the invention.

DETAILED DESCRIPTION OF THE INVENTION

Figure 1:
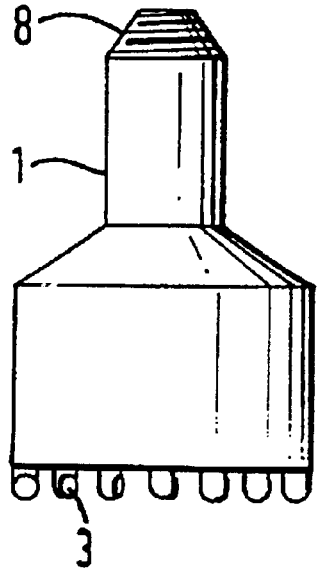
FIG. 1 PRIOR ART
FIG. 1 represents a cross-section of a known drill bit shown schematically.

Referring to schematic FIG. 1, a known drill bit has a shank 1 with a thread 8 for engaging a drilling string (not shown) and having set of cutters 3 rigidly mounted therein. The shank is integral part of the bit body so, when in use, the cutters are rigidly connected to the drill string.

Figure 2:
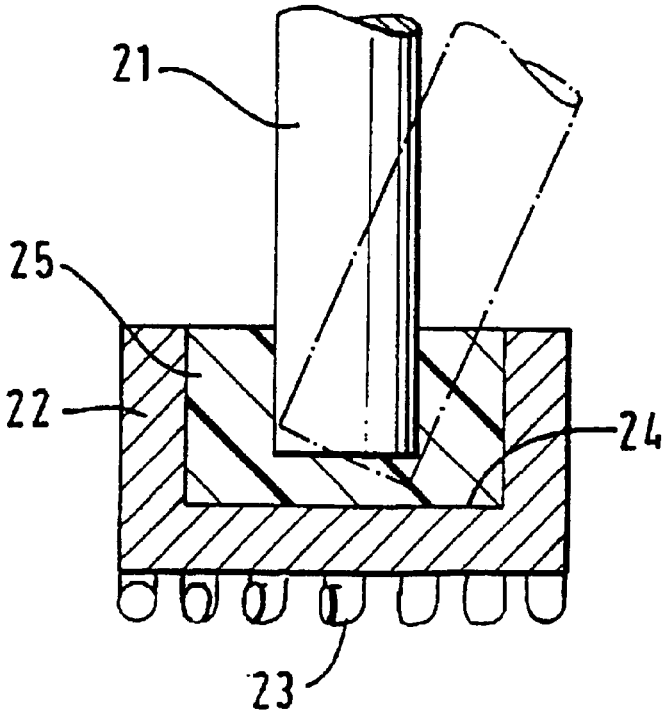
FIG. 2 represents an axial cross-section through a schematic drill bit of the invention.

FIG. 2 shows schematically an inter relation between shank 21, bit body 22 and cutters 23, in which the bit body 22 has a mouth 24 containing a flexible matrix as spacer 25 into which extends shank 21. There is also shown to a distorted extent the position of shank 21 when the bit body 22 is tilted with respect to the shank, hence remaining in contact with the formation 25.

Figure 3A:
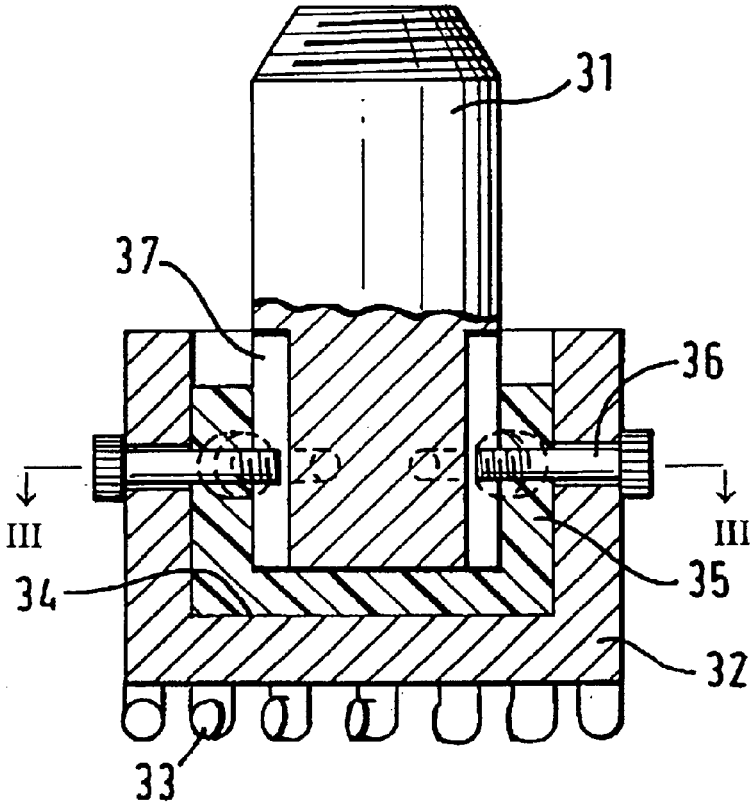
FIGS. 3A/3B provides more detail of the bit of FIG. 2.
Figure 3B:
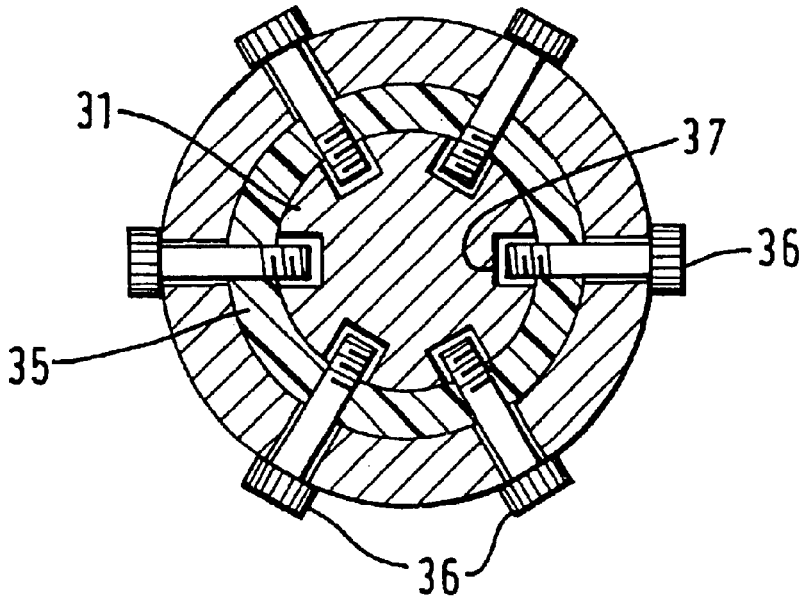
FIG. 3B is a cross-sectional view taken along the line III—III of FIG. 3A.

FIGS. 3A/3B provides more detail on the bit assembly of FIG. 2 and has shank 31, bit body 32, cutters 33, mouth 34 and spacer 35, analogous to items 21–25 in FIG. 2. But FIGS. 3A/3B also shows bolts or pins 36 rigidly fixed to and extending through bit 32. The bolts 36 enter longitudinal axis groove recesses 37 of shank 31 in order to enable transmission of torque from the shank 31 to bit body 32, but there is sufficient clearance between bolts 36 and recesses 37, so that coupled with the presence of elastomeric spacer 35 the bit body 32 is able to tilt or rotate up to 10° relative to shank 31. FIG. 3B shows a section AA of FIG. 3A illustrating the relative location of bolts 36 entering recesses 37 in shank 31. The clearance shown in FIGS. 3A and 3B between bolts 36 and recesses 37 allows a small lateral movement of bit 32 relative to shank 31. A bit assembly according to FIGS. 3A/3B of 40 mm diameter has been shown in laboratory tests to drill much more smoothly and more concentrically than a corresponding rigid assembly according to FIG. 1. In the test the weight on bit (WOB) was slowly increased while the bit was rotated at constant speed. When the WOB was above a certain level, the bit vibrated so much that it did not remain in contact with the surface being drilled. In the test, this limiting WOB for the assembly of FIGS. 3A/3B was about 3.7 times than that for the assembly of FIG. 1. Moreover the drilling with the FIGS. 3A/3B assembly ran much more smoothly than that with the FIG. 1 assembly.

Figure 4:
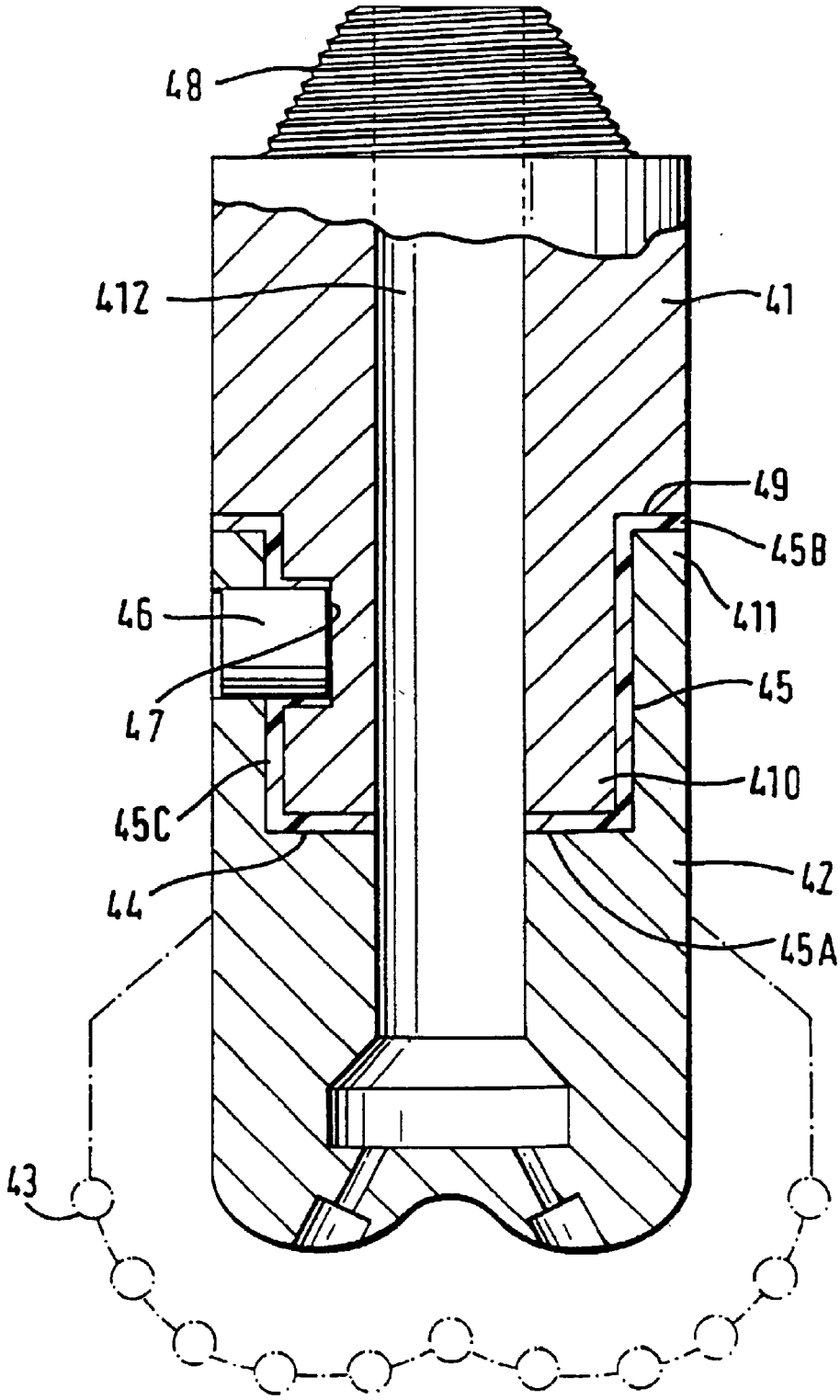
FIGS. 4, 5, GA, 7A, 8, 9, 10, 11, 12A and 12B represent respective axial cross-sections through other drill bits of the invention.

Referring now to FIG. 4, the assembly comprises a hollow shank 41 separated from a hollow bit body 42 by a flexible cup shaped spacer 45 which has two radial parts 45A, 45B joined by an axial part 45C. Mounted on the bit body 42 distant from the shank 41 is a set of cutters 43, shown schematically. Shank 41 has screw thread 48 for engagement with drill pipe (not shown). Distant from said thread 48, the shank 41 has an inward ledge 49 leading to a nose 410 in which are disposed 6 circumferential recesses 47 (only one of which is shown for convenience). Bit body 42 has a hollow or mouth 44 generally adapted to receive nose 410 and a shoulder 411 to receive ledge 49 but in both cases separated therefrom by spacer 45. Bolts or pins 46 are rigidly fixed in and pass through bit body 42, and interact with recesses 47 to secure shank 41 to bit body 42 and allow torque to be transferred between them (in the manner shown in FIG. 3B), but also via interaction with spacer 45 to allow tilt movement of bit body 42 relative to shank 41, against the restriction of spacer 45. Pins or bolts 46 may be secured further in place by a welded belt (not shown).

Bit body 42, like shank 41, has an axial passage 412 for drilling fluid, and bit body 42 also has outlets 413 for that fluid. Cutters 43 are located on bit body 42 in an arrangement known per se e.g. on a double parabolic profile.

The clearance between all opposed surfaces of bit body 42 and shank 41 may be the same, but is preferably larger between axial surfaces than radial ones (as shown).

Figure 5:
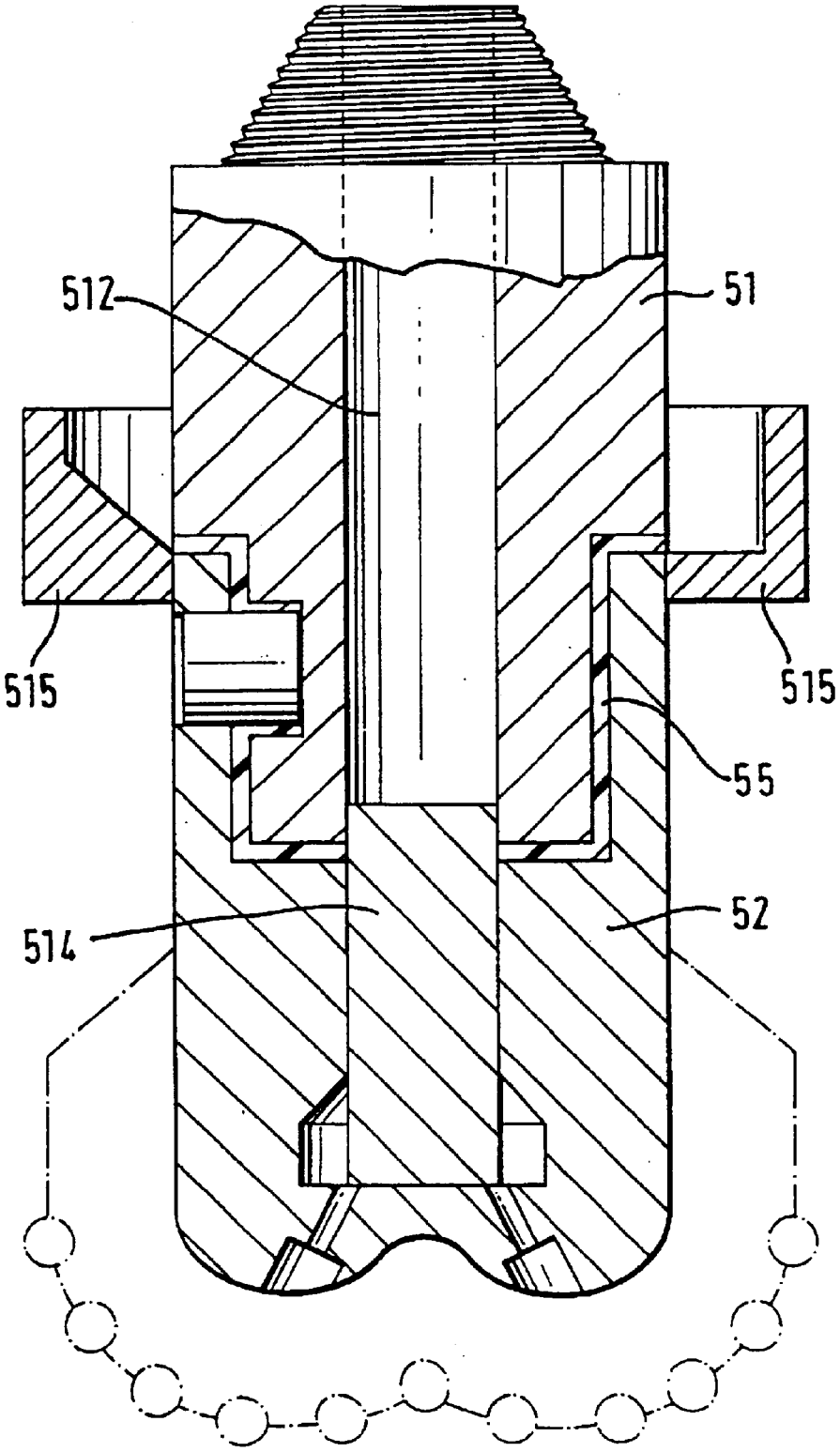

FIG. 5 shows an assembly the same as in FIG. 4 but with a plug 514 to seal axial passage 512 from the spacer 55 between bit body 52 and shank 51. Surrounding bit body 52 just below spacer 55 is a ledge ring or trough 515, which is used temporarily during construction of the assembly for directing a liquid elastomer between bit body 52 and shank 51 prior to its setting in situ to form an elastomeric spacer 55 and sealer.

Figure 6A:
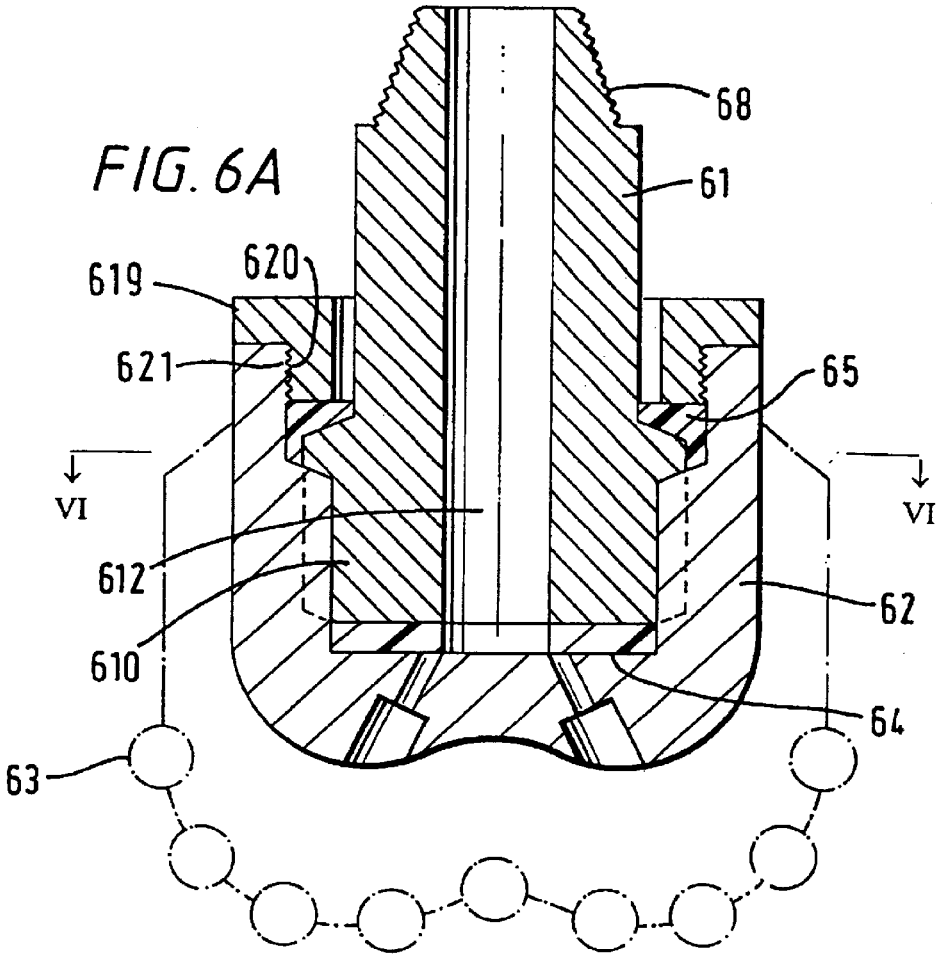
FIGS. 6B, 7B and 7C, and 13 represent transverse sections along the indicated lines in FIGS. 6A, 7A and 12A, respectively.
Figure 6B:
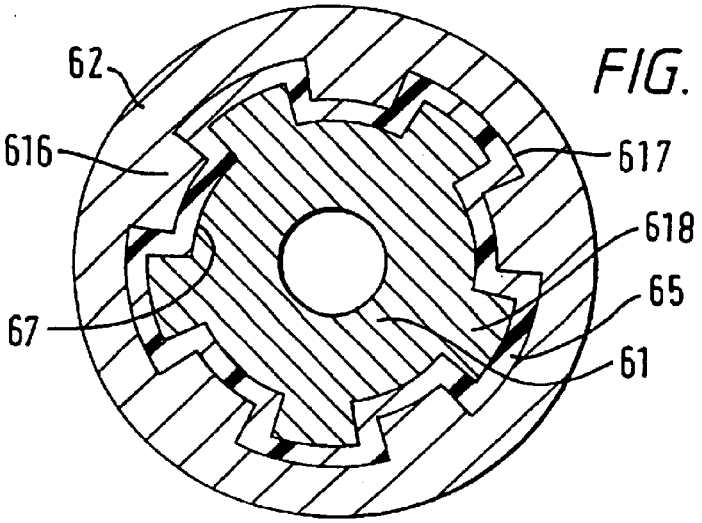

FIG. 6A shows an assembly with an alternative to the separate bolts or pins 46 of FIG. 4 and FIG. 6B shows a section through the assembly of FIG. 6A. In FIG. 6A, there are a shank 61, bit body 62, cutters 63, thread 68, nose 610, mouth 64 and central passage 612, all equivalent to items 41, 42, 43, 48, 410, 44 and 412 of FIG. 4. Instead of separate pins 46 rigidly passing through bit body 42 and entering recesses 47, the present embodiment has inward facing teeth 616 integral with bit body 62 (and machined therein) and inward facing recesses 617 in bit body 62 which loosely mesh in the manner of gear cogs with corresponding recesses 67 and teeth 618 formed in shank 61. Between all the teeth and their recesses is an elastomeric spacer 65. A locking ring 619 surrounds shank 61 and has outward facing threads 620 which engage corresponding inward facing threads 621 on bit body 62. Ring 619 bears upon spacer 65 to lock bit body 62 onto shank 61 but allow tilting. In this embodiment bit body 62 and shank 61 are in direct contact, on one side of teeth 618 in an axial direction, but not on the other side, though (not shown) spacer 65 may separate bit body 62 and shank 61 from contact anywhere.

Figure 7A:
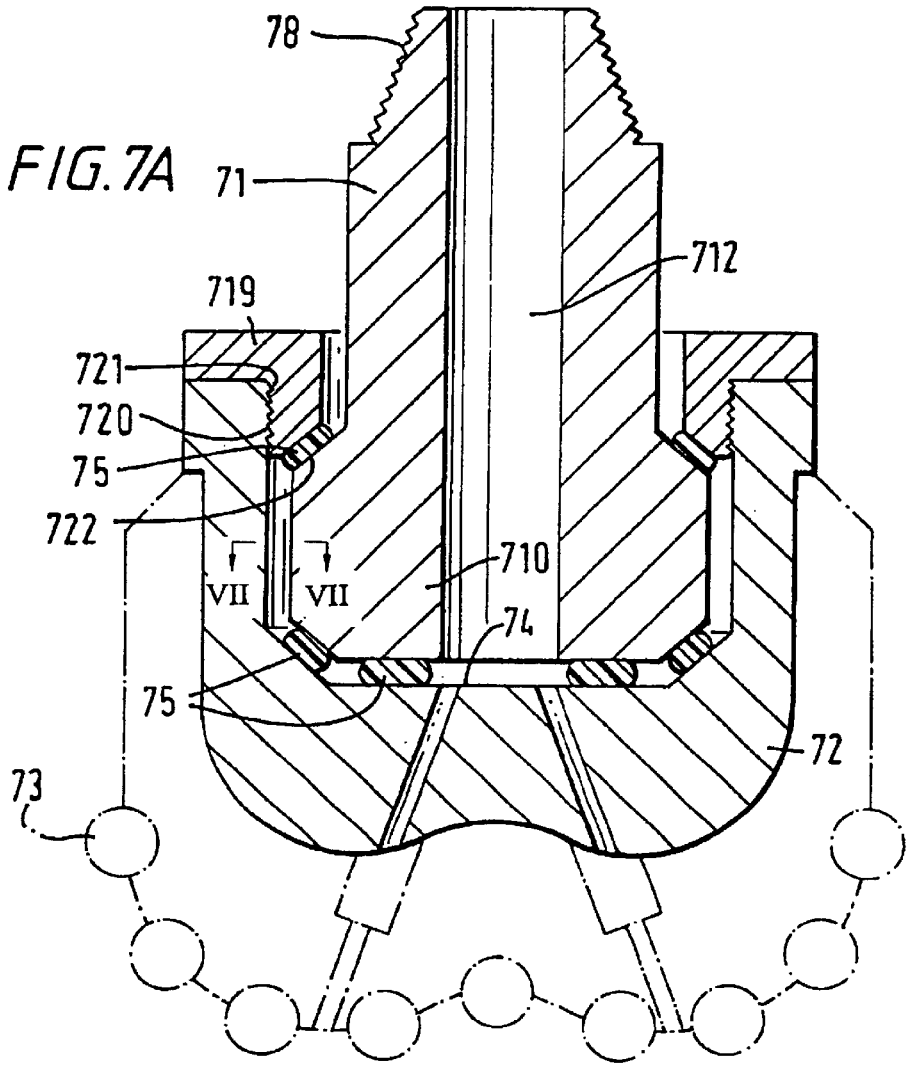
Figure 7B:
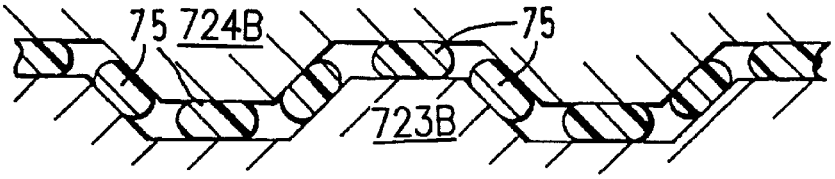
Figure 7C:
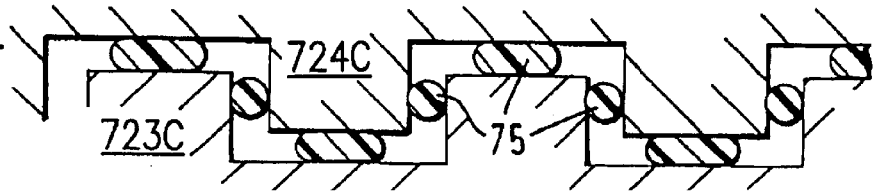

In FIG. 7A, there is also shank 71, bit body 72, cutters 73, thread 78, nose 710, mouth 74 and central passage 712, ring 719 and threads 720 and 721 all equivalent to items 61, 62, 63, 68, 610, 64, 612, 619, 620, 621 of FIG. 6. In this case instead of teeth 618 on shank 61, there is on shank 71 and extending circumferentially an outward facing ridge 722, which may be of gradually increasing diameter (as shown) or radial and is separated from locking ring 719 by spacer 75; this spacer provides the facility for tilting bit body 72 relative to shank 71. As shown in FIGS. 7B and 7C, in enlarged partial cross-section, the torque transfer mechanism comprises a series of loosely enmeshing cogs 723 and 724 of chamfered (FIG. 7B) or square (FIG. 7C) cross section and formed in the mouth 74 and nose 710 of the bit body 72 and shank 71 respectively. Space between the cogs 723 and 724 is at least partly filled with further elastomeric spacer 75.

Figure 8:
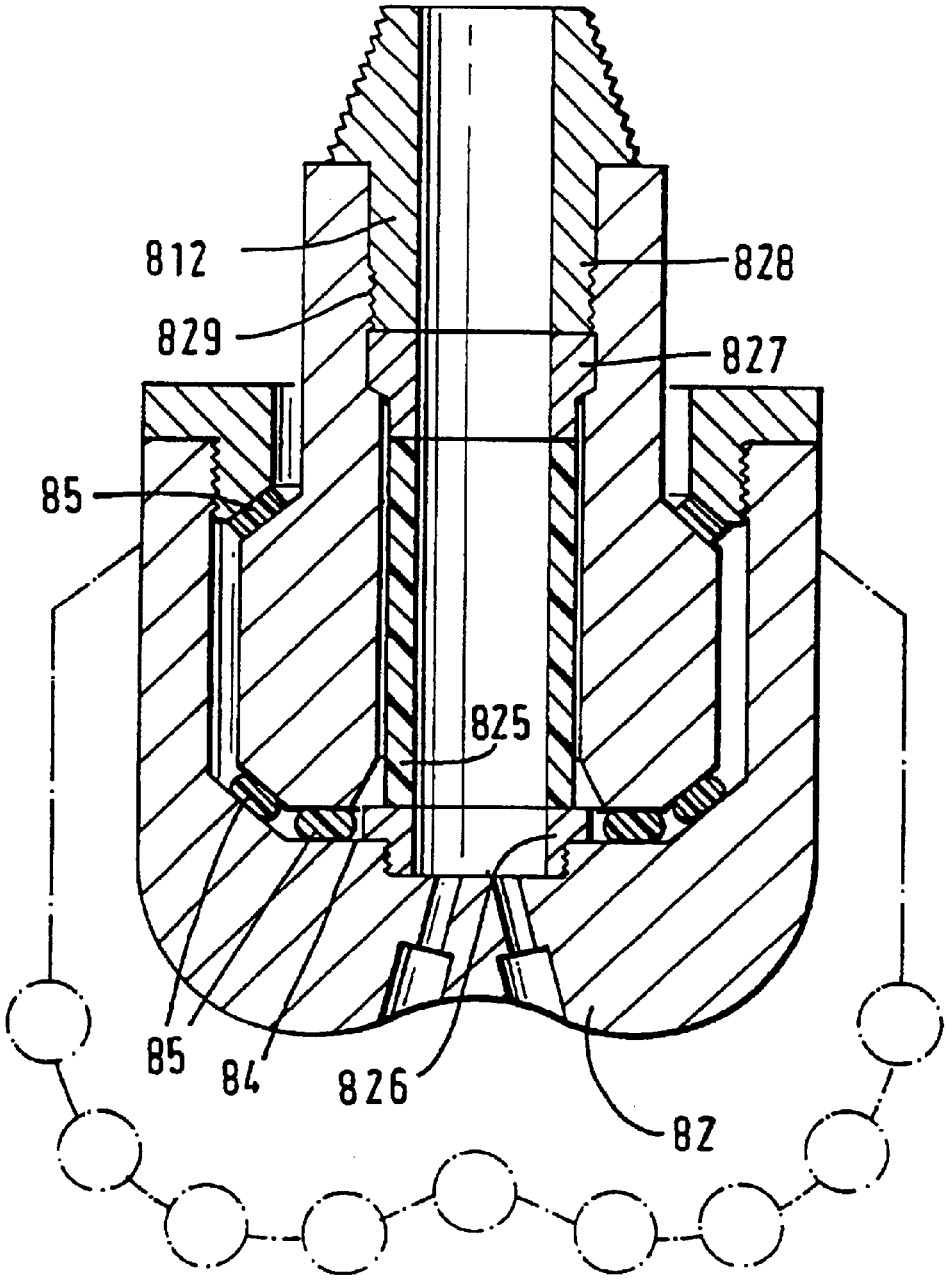

FIG. 8 concerns a modification of the assembly of FIG. 7 in which a flexible reinforced elastomeric pipe 825 having an externally threaded lower member 826 and outwardly extending upper member 827 attached thereto is located in the central passage 812. The upper member 827 bears on a corresponding ridge in passage 812 and is sealingly held in place by a threaded ring 828 engaging threads 829 inside passage 812. The lower member 826 of the pipe 825 arrangement sealingly engages corresponding threads on the mouth 84 of bit body 82. Fluid moving through passage 812 is thus constrained to flow through the pipe 825 and not to leak past elastomeric spacers 85 in mouth 84. This assembly is useful when the drilling fluid is of high velocity and/or high pressure and prevents "wash out". Also (not shown) the flexible pipe 825 arrangement may be used in a modification of the assembly of FIGS. 4–6, 10 or 11.

Figure 9:
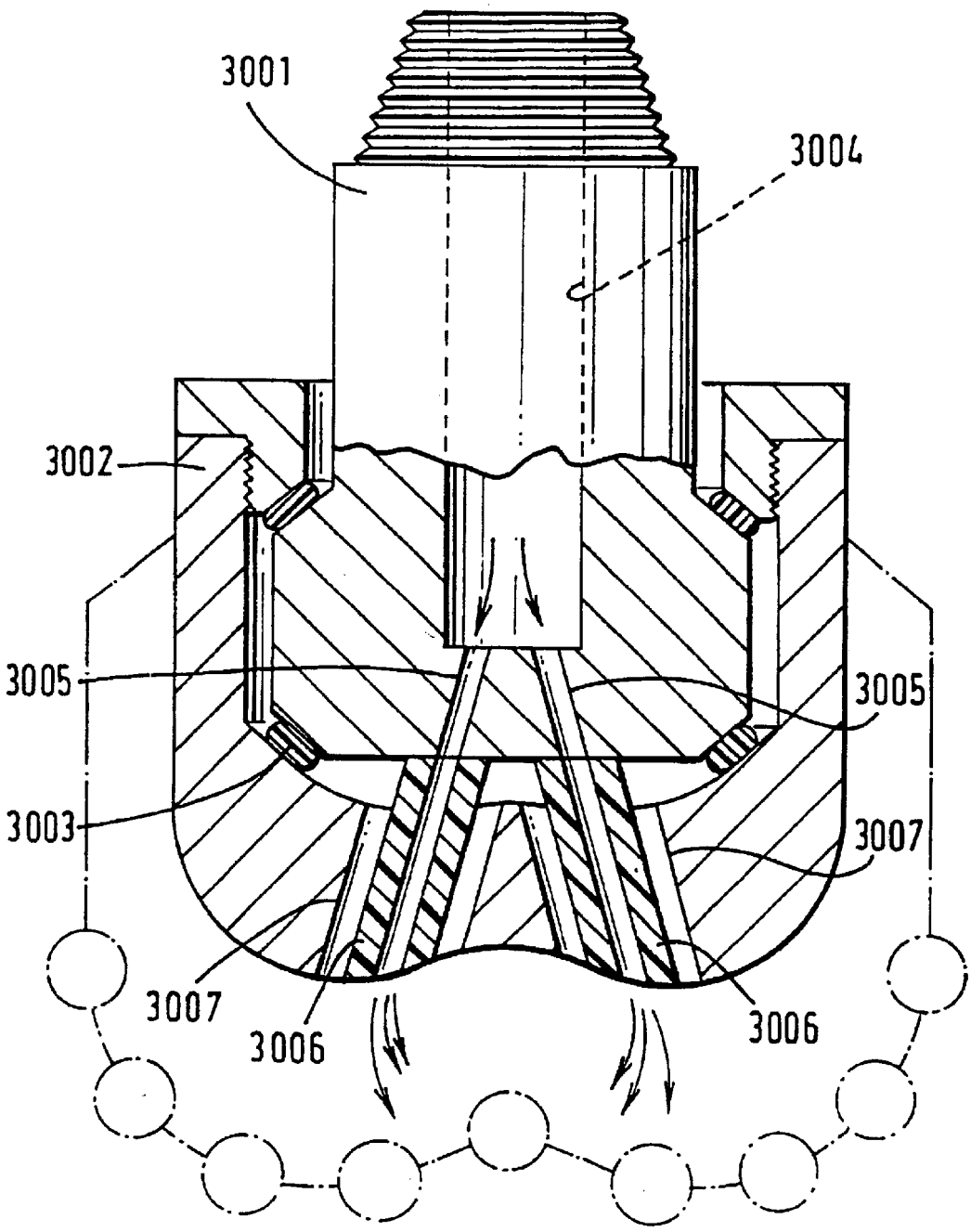

FIG. 9 shows a modified version of the embodiment of FIG. 8, which is adapted to obviate the exercise of high fluid force on the lower member 3002. With large size drill bits in particular, the rate of fluid flow can be so high as to exercise an excessive force on the lower member 3002 as well as on the flexible seal 3003. In this embodiment the upper member 3001 has a blind axial fluid passage 3004 having outlet bores 3005 formed at its lower end. Protruding pipes 3006 are provided on the upper member 3001 and form downward extensions of the outlet bores 3005. The pipes 3006 pass through holes 3007 formed in the lower member 3002 so as to distribute the fluid beneath the lower member 3002. The holes 3007 are preshaped in the lower member 3002 so as to provide enough clearance between the pipes 3006 and the lower member 3002 to allow the lower member to tilt with respect to the upper member.

Figure 10:
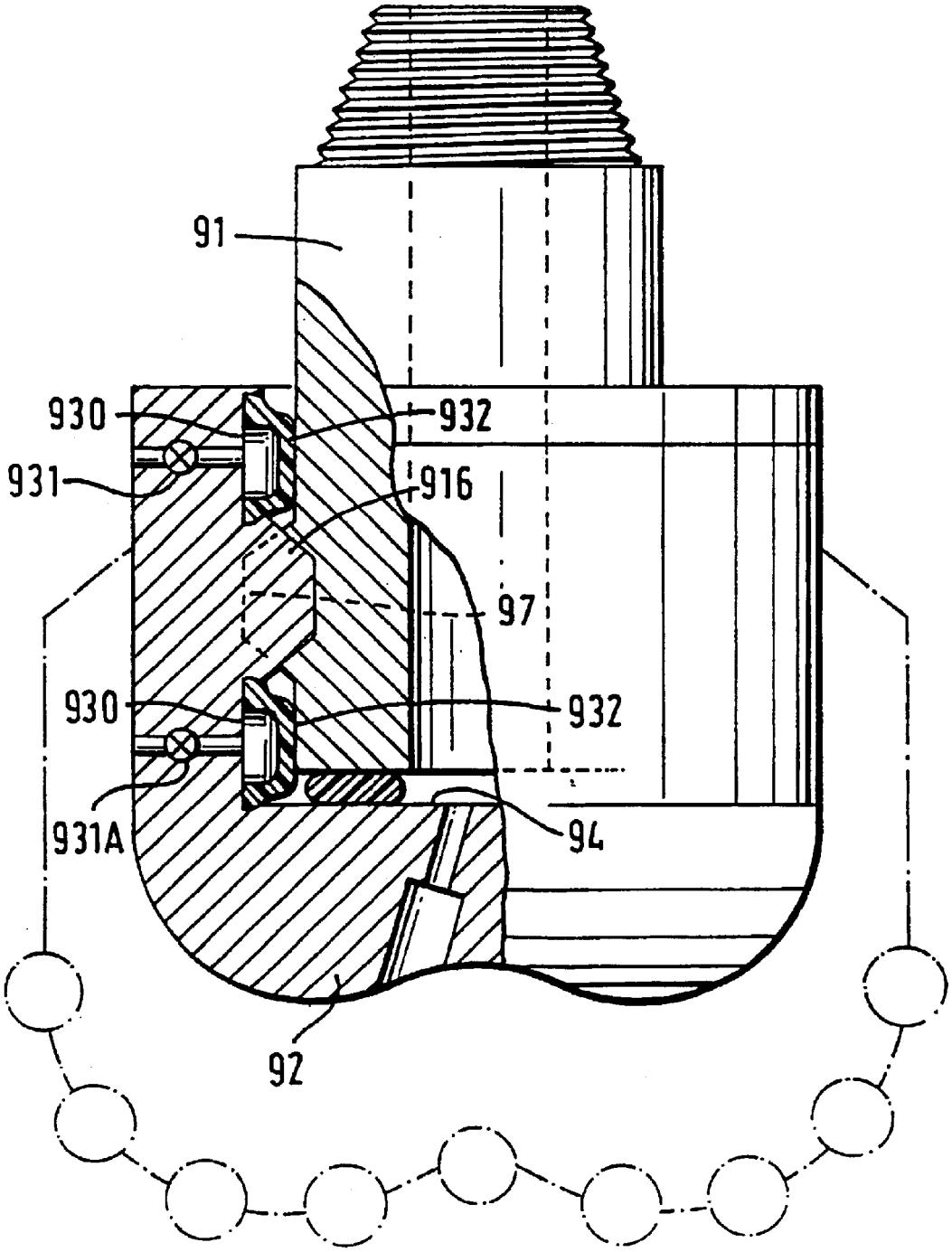

FIG. 10 shows an alternative method of providing the tilt facility and can be adapted also to transfer torque. Bit body 92 has two inward facing circumferential recesses 930 in the upper section of its mouth 94; recesses 930 are connected to the outside of bit body 92 by way of conduit 931, fitted with valve 931A. Intermeshing teeth and recesses 916 and 97 are located and perform as do members 616 and 67 in FIG. 6. Located in each of recesses 930 is a continuous flexible band 932 closed in an inward direction but open in an outward direction thereby forming a toroid with an outward opening 931; this band may if desired be reinforced e.g. with steel circumferential reinforcement (not shown). The inward face of band 932 bears on shank 91 when in use. To construct this assembly, bands 932 are located in their recesses 930, glued in place and then shank 91 is inserted into mouth 94. Then compressed gas e.g. air or inert gas is passed into band 932 through conduit 931 and valve 931A is closed. The pressurized band 932 enables bit 92 to be tiltable relative to shank 91. If desired (not shown) band 932 may be replaced by an inflatable tube to form a toroid. In both alternatives the pressure and the coefficient of friction between the band 932 and shank 91 may be adapted such that the band 932 may be used to transmit torque, and then it would be possible to reduce the number of teeth and recesses 916 and 97, or omit them completely.

Figure 11:
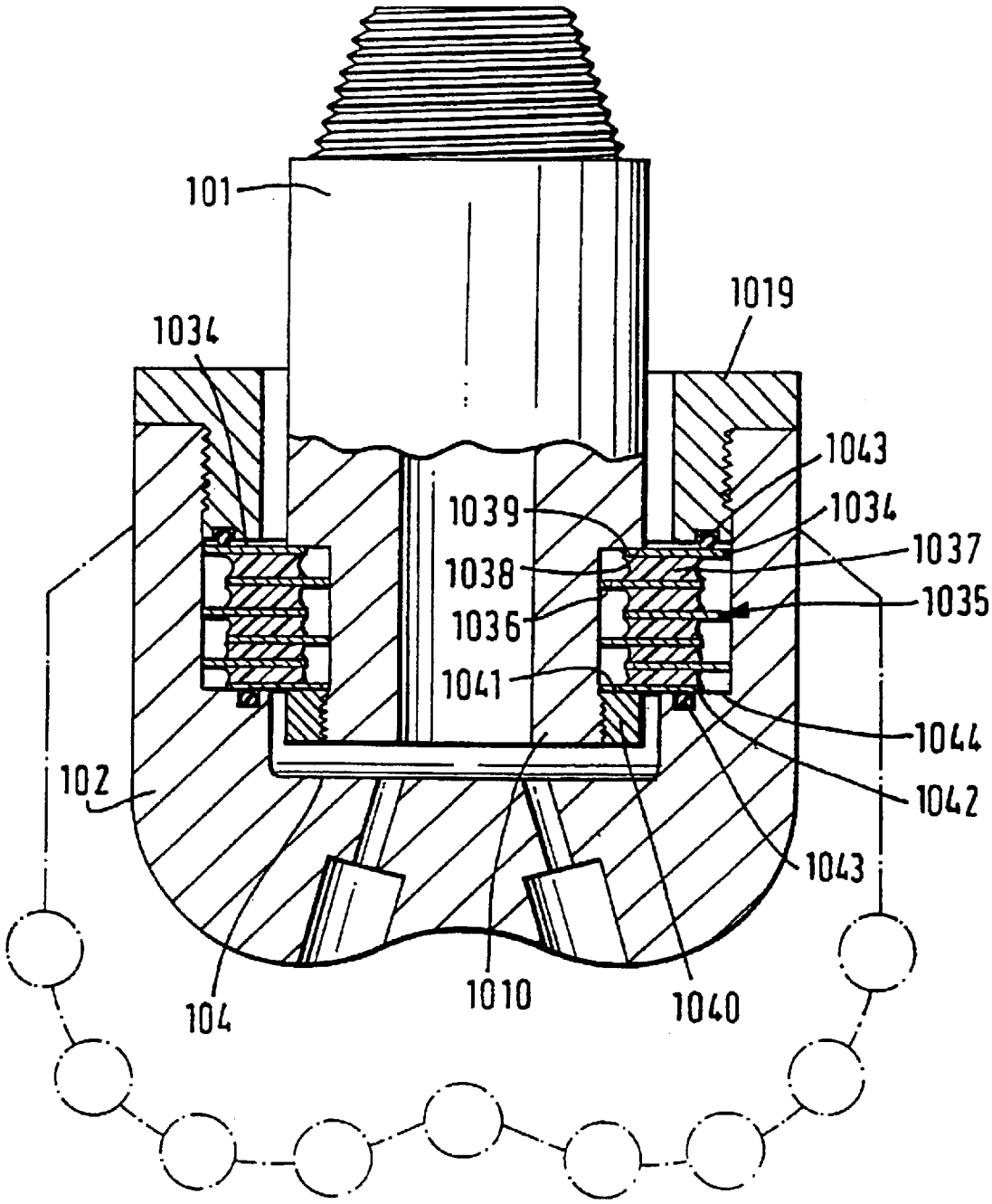

FIG. 11 shows a schematic modification of the assembly of FIG. 6, in which locking ring 1019 bears upon an upper outer surface 1034 of a multi-layered gasket 1035 having external and internal metal rings or washer 1036 separated by elastomer layers 1037. An upper inner surface 1038 of the gasket 1035 bears upon an inwardly extending surface 1039 of shank 101. The gasket 1035 is locked in place on the nose 1010 of shank 101 by shank locking ring 1040 which bears upon the lower inner surface 1041 of gasket 1035. Lower outer surface 1042 of gasket 1035 bears upon an outwardly extending ledge 1044 in mouth 104 of bit body 102. Sealing rings e.g. O-rings 1043 are provided above and below upper and lower outer surfaces 1039 and 1042. Torque transfer means (not shown) may be as in FIGS. 4–10 but having the interaction between each opposing face and the corresponding shank 101 and bit body 102 rather than e.g. shank 41 and bit body 42. Instead of horizontal rings 1036 to reinforce the elastomer layers 1037 there may be used vertical metal tubes (not shown) separated by elastomer layers 1037 but having in this case no tube extending completely between opposing faces of the gasket so that are elastomeric layers between the tube and the external surfaces 1034, 1038, 1041 and 1042.

Figure 12A:
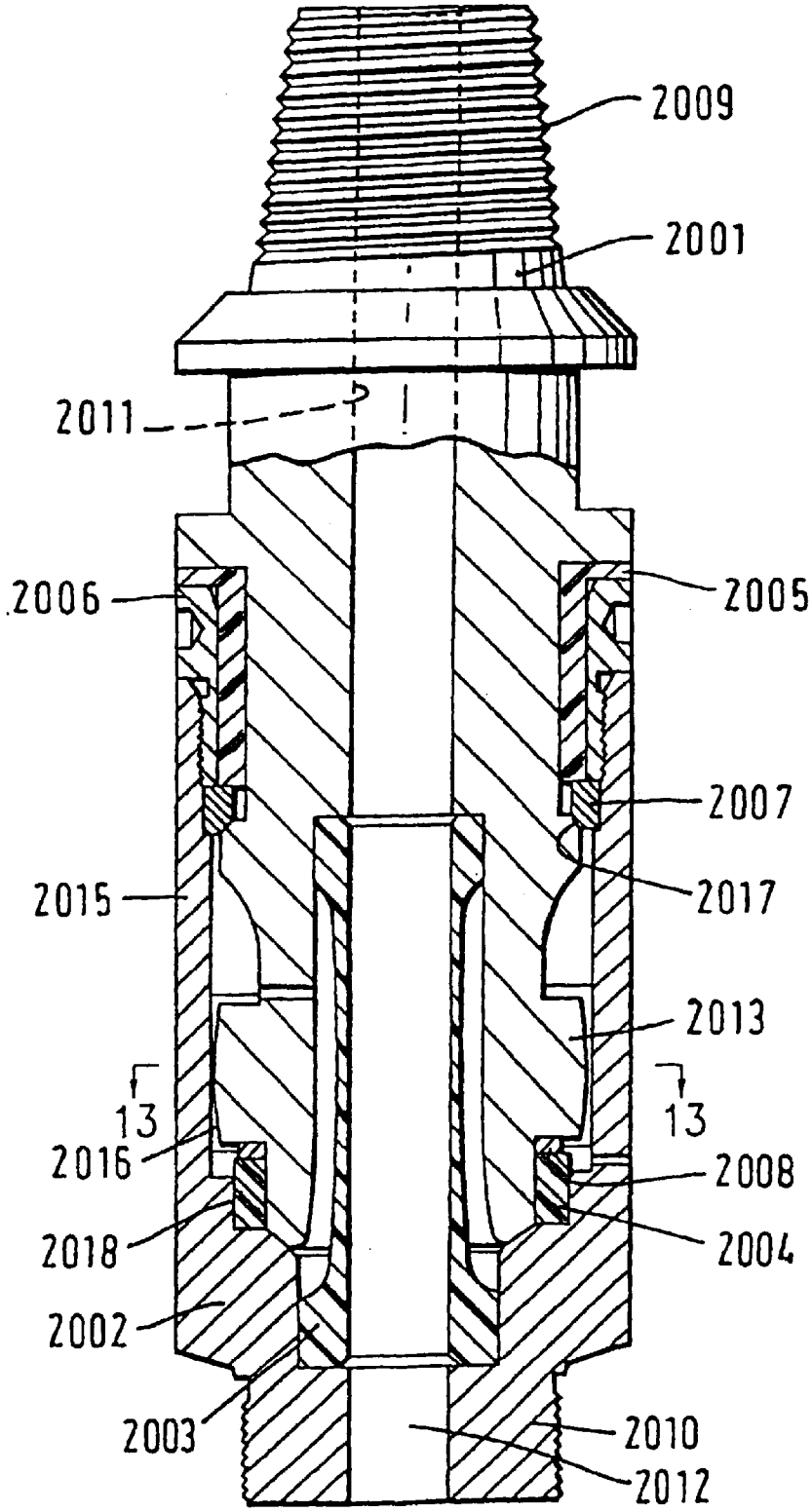
FIGS. 12C and 12D represent axial cross-sections through sub-assemblies in accordance with another aspect of the invention for incorporation in drill strings for rotating drill bits which may or may not be in accordance with the invention.
Figure 13:
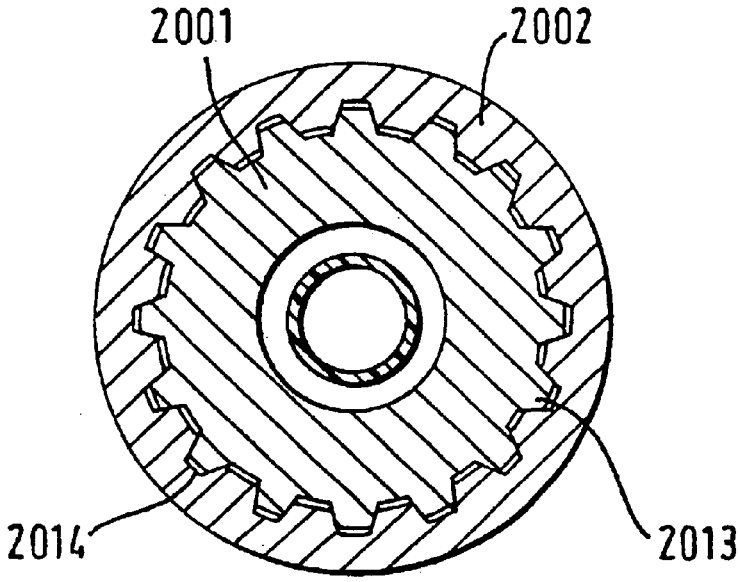

FIGS. 12A and 13 show a further embodiment in the form of a sub-assembly for incorporation at a selected position in a drill bit assembly or a drill string. The sub-assembly comprises an upper body 2001 having a threaded shank connector portion 2009 for attachment directly or indirectly to a drill string, and a lower body 2002 having a connector portion 2010.

Figure 12B:
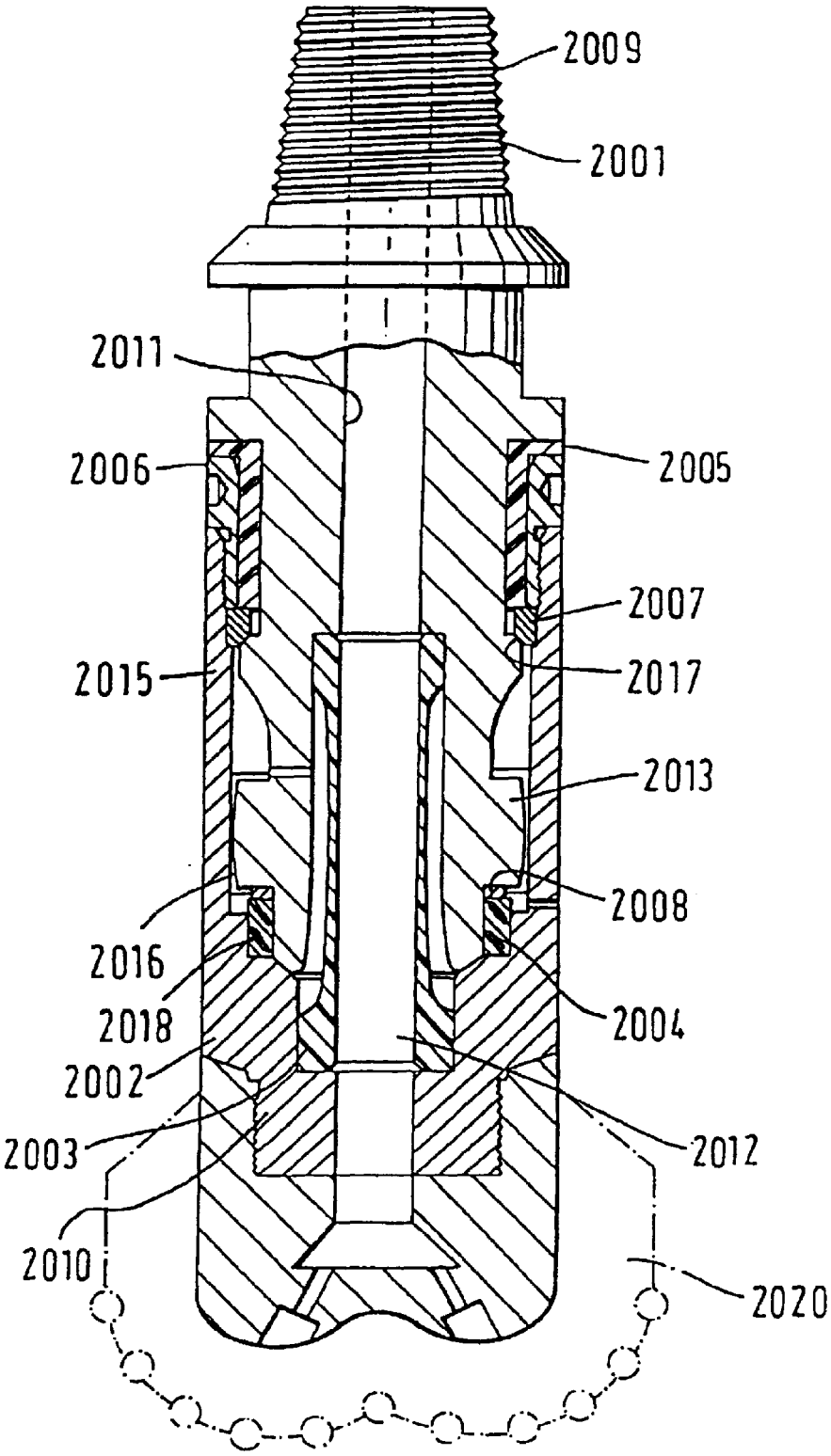
Figure 12C:
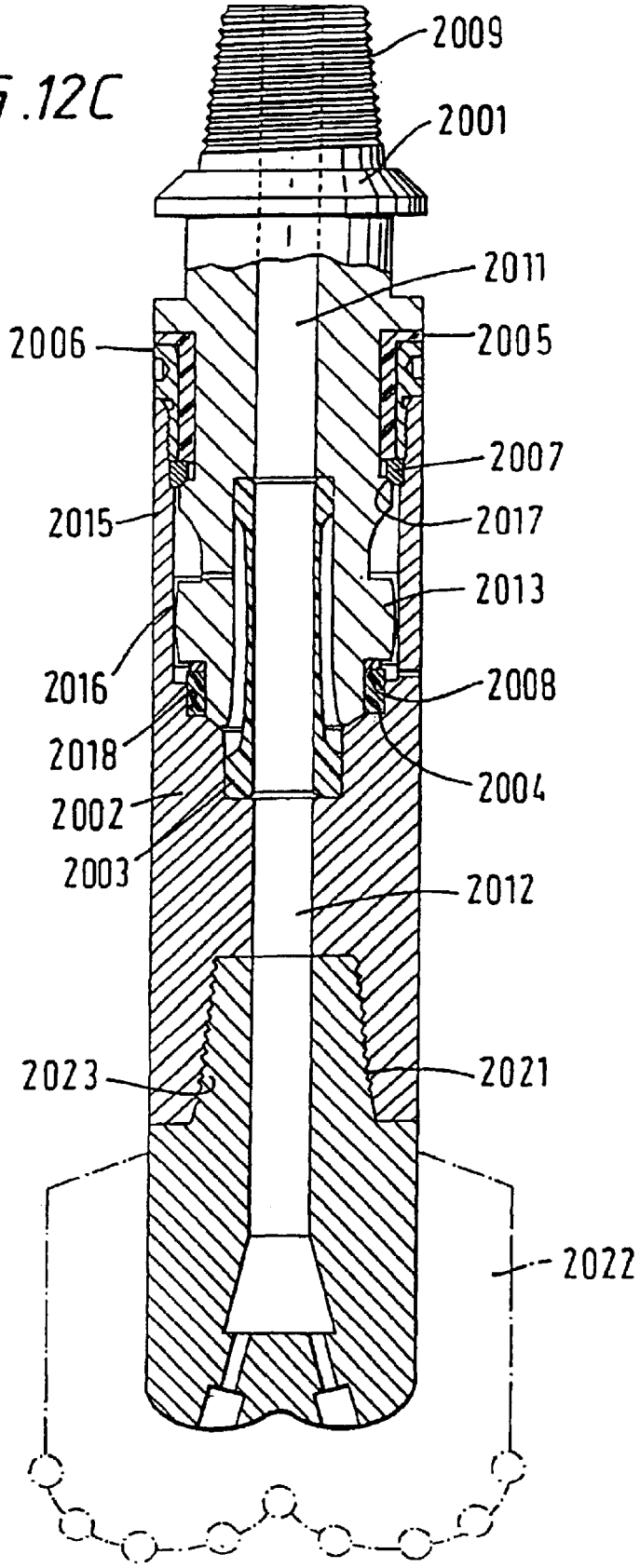
Figure 12D:
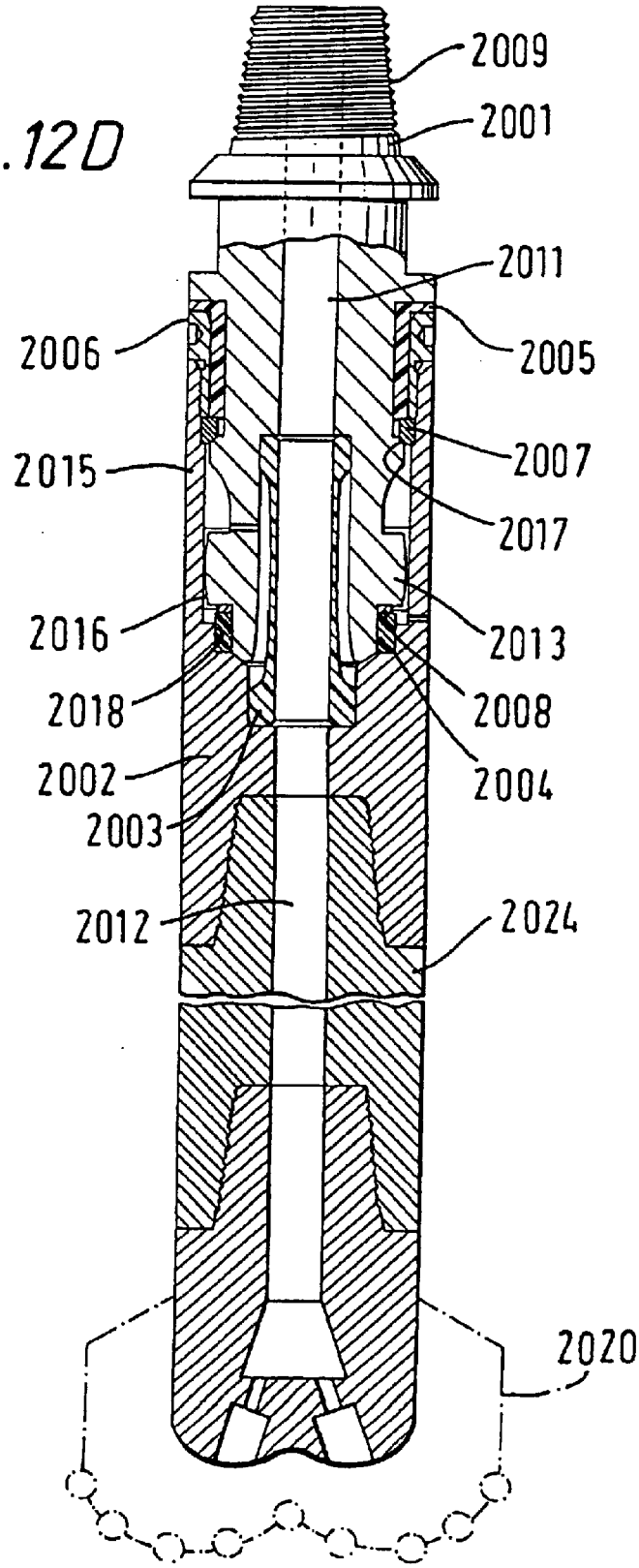

The sub-assembly may be incorporated in the drill bit as an integral part of the drill bit as illustrated in FIG. 12B. In this embodiment, the drill bit 2020 is made an integral part at the lower end of the lower body 2002 and the upper body 2001 constitutes the drive shank of the drill bit. FIG. 12C shows an embodiment in which the lower end of the lower body 2002 is formed with a taper threaded recess 2021 to receive the tapered threaded shank 2023 of any suitable bit 2022. FIG. 12D shows the sub-assembly of FIG. 12C but incorporated in the drill string at a position spaced above the drill bit 2020 by a spacer element 2024 in accordance with different drilling applications and requirements.

The upper and lower bodies are arranged coaxially and have aligned central bores 2011, 2012 which are sealed with respect to one another by an annular flexible seal 2003. As illustrated in FIG. 13 the upper body 2001 has at its lower end, a radial series of gear teeth 2013 which loosely end in corresponding recesses 2014 formed in an annular encircling wall portion 2015 of the lower body 2002. Each gear tooth 2013 has a barrel-shaped end face 2016, as seen in cross-section in FIG. 12A, which allows relative tilting of the upper and lower bodies 2001, 2002 whilst providing a torque driving connection therebetween.

The external wall of the upper body 2001, above the gear teeth 2013, is formed with an annular shoulder 2017. A thrust ring 2007 is located on the shoulder 2017. In some embodiments, the thrust ring 2017 may be a two-piece construction to facilitate insertion thereof. The cooperating surfaces of the thrust ring 2007 and the shoulder 2017 are arcuate to permit the aforesaid relative tilting of the upper and lower bodies.

A locking ring 2006 is threadably engaged within the upper end of the wall portion 2015 of the lower body 2002 to seat on the thrust ring 2007.

An upper elastomeric vibration ring 2005, having an L-shaped cross-section as seen in FIG. 12, is disposed between both annular circumferential and radial opposed surfaces of the upper body 2001 and the locking ring 2005. A lower elastomeric vibration ring 2004 is disposed in an annular recess 2018 within the lower body 2002 to engage the external wall of the lower end of the upper body 2001. a spacer ring 2008 separates the vibration ring 2004 from the gear teeth 2013.

Figure 14:
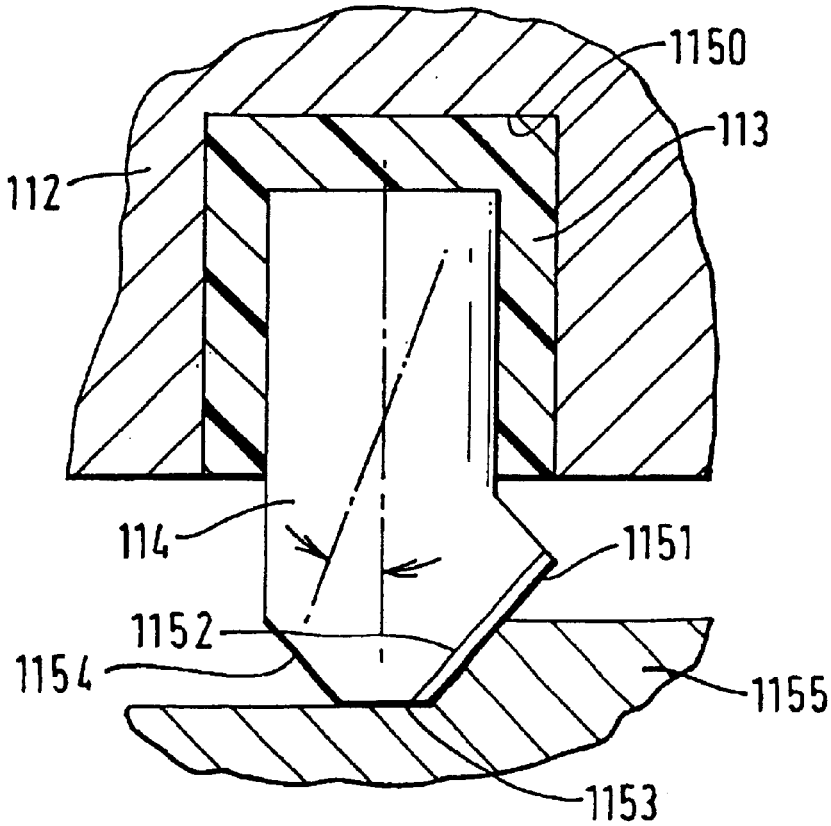

FIG. 14 shows, in schematic close up, a relation between bit body 112, cutter 114 and flexible matrix 113. Bit body 112 has a recess 1150 generally adapted to receive cutter 114 (also known as a stud), but be separated therefrom by elastomeric matrix 113. Cutter 114 has a PDC wafer 1151 mounted on a chamfered edge 1152 with cutter 114 having a flat end 1153 (a wear flat) and chamfered side 1154. In use wafer 1151 is forced against the rock formation 1155, causing cutter 114 to tilt in a clockwise direction thereby lifting the wear flat 1153 off formation 1155, increasing the relief angle, hence increasing the ability to penetrate the formation, an advantage in addition to the decrease of vibration level. The gap between cutter 114 and bit body 112 is preferably such that it allows a maximum tilt of up to 10 degrees. This gap depends in the depth of insertion of the cutter 114, the cutter width and cutting force level exerted on the cutter. For example, the gap between cutter 114 and bit body 112 is at least 1 mm and usually 2–4 mm, when the depth of insertion in the recess 1150 is 10–30 mm and width of cutter 114 is 10–25 mm.

Figure 15:
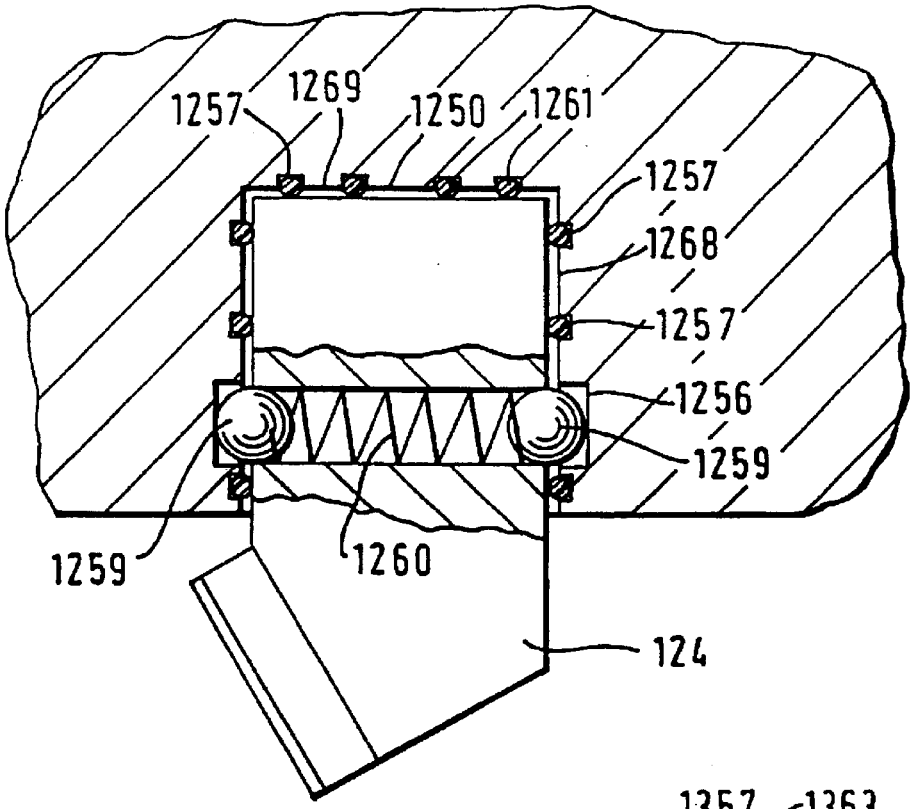

FIG. 15 shows an improvement in the arrangement of FIG. 14 with the recess 1250 containing a large circumferential slot 1256 and a plurality of smaller circumferential grooves 1257 in the curves recess wall 1268 and also in the flat end 1269 of the recess 1250. In the slot 1256 are two balls or cylinders 1259 separated by springs 1260. In grooves 1257 are elastomeric O-rings 1261. Cutter 124 is held in the recess 1250 by the spring/balls 1259/1260 but is able to tilt against the elastomeric rings 1261. The balls 1259 provide a pivot point. Lab tests have shown that such an arrangement will accept loads of up to 4000 Kg.

Figure 16:
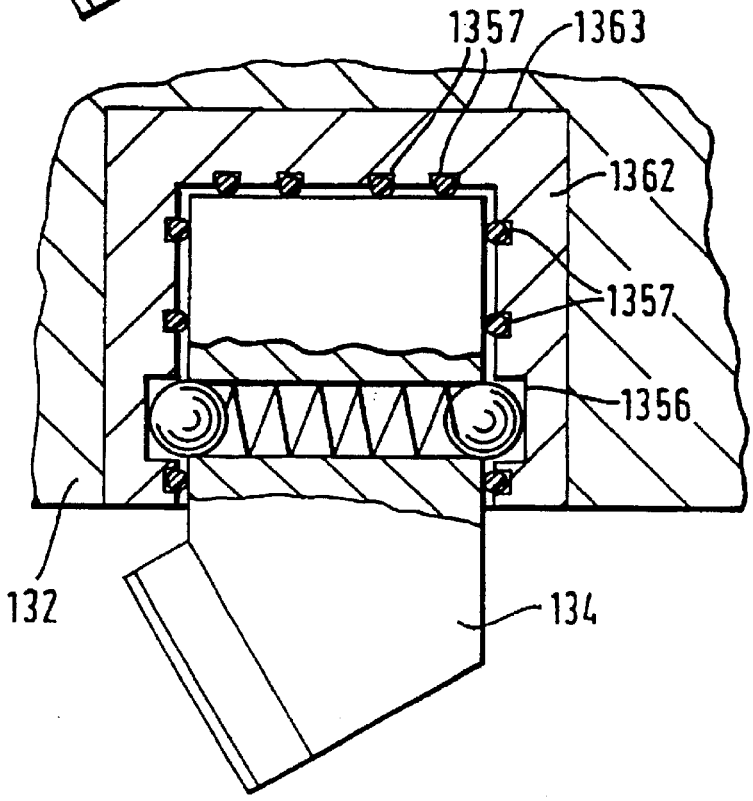

FIG. 16 shows a modification of the arrangement of FIG. 15 in which the cutter 134 is received in a preshaped socket 1362, which has the slots/grooves 1356 and 1357 etc. as 1256 and 1257 in FIG. 14 but the socket 1362 itself is received in a recess 1363 in the bit body 132. Socket 1362 may be of harder material than the bit body 132, e.g. when the socket is of sintered carbide and bit body is of steel or matrix material.

FIG. 17 shows a modification of FIG. 15, in which the recess 1450 is of outwardly reducing cross-section e.g. of generally frustoconical shape. A hollow frustoconical elastomeric stud catcher 1463 is in the recess 1450 and surrounds and grips the cutter 144, which is separated from the end face 1464 of the recess 1450 by a spring 143 or a resilient component e.g. an elastomeric spacer (143) which forces the cutter 144 against the grip of the catcher 1463. If desired a layer of adhesive (not shown) may be present between catcher 1463 and cutter 144 to increase the retention of cutter in the socket. Catcher 1463 may be retained in recess 1450 by means of an internally facing lip 1465 to recess 1450.

FIG. 18 shows the separate socket approach of FIG. 16 applied to the reduced cross-section recess approach of FIG. 17 and is self explanatory.

FIGS. 19A/19B show a modification of the arrangement of FIG. 15, with cutter 164 retained in bit body 162 and spaced therefrom by elastomeric O-rings 1661. FIG. 19A shows the arrangement with a cutter 164 having an outer flat end 1653 and PDC wafer 1651. The flat end 1653 may have been machined or moulded, in a new cutter or may have been worn flat as in a used cutter. FIG. 19B shows the arrangement of FIG. 19A under load in use and shows the wafer 1651 contacting the formation, and the tilt allowing the relief angle to increase. This device is very suitable for entering harder formations.

Figure 20A:
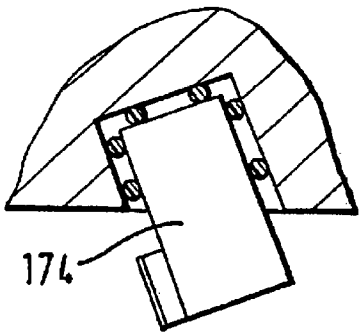
Figure 20B:
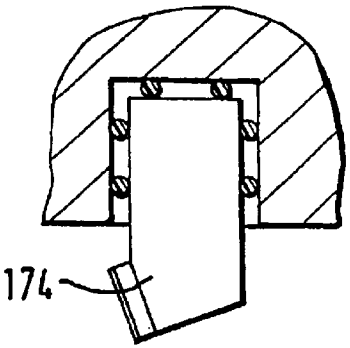
Figure 20C:
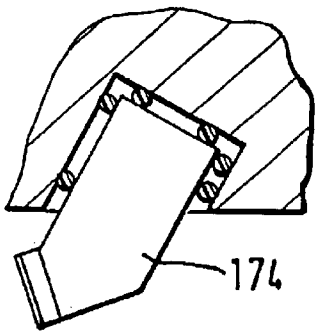
Figure 20D:
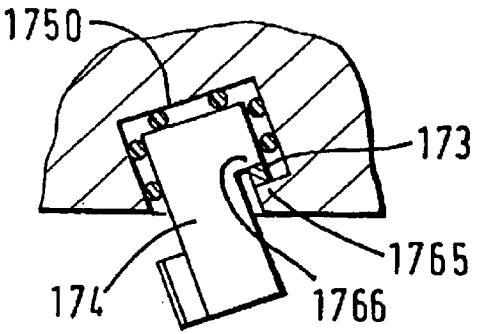
Figure 20E:
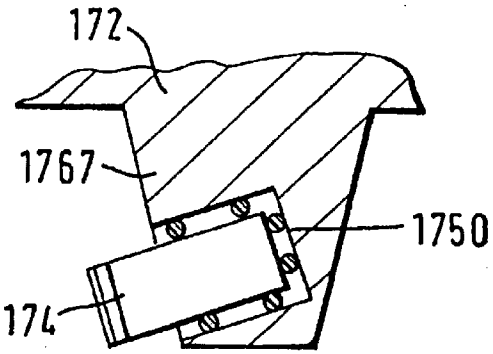

In FIGS. 14–19A/19B, the cutter is substantially perpendicular to the bit body, but can be inclined either towards or away from the direction of movement of the bit as shown in FIGS. 20A–E which illustrate four variations on the FIGS. 19A/19B arrangement. Extra support may be needed in a FIG. 20A approach to stop the cutter 174 being pulled out in use. An example of this support is shown in FIG. 20D, in which cutter 174 has a ledge 1766 separated from a corresponding lip 1765 on recess 1750 by elastomeric spacer 173. In FIG. 20E recess 1750 for cutter 174 may be in a protrusion 1767 of the bit body 172, as in a bladed bit. The arrangement in FIG. 20C can be valuable when drilling from a hard to a soft formation e.g. from sandstone to shale. Lowering the WOB will increase the relief rake and hence allow a cutter which has been flattened by the hard sandstone to be very active in the softer shale.

In the embodiments of FIGS. 14–20, each cutter is mounted on the bit body so as to allow tilting of and/or relative lateral movement of the cutter with respect to the bit body. Such arrangements can be utilized in embodiments of the invention, e.g. as illustrated in FIGS. 2–11, in which the bit body is also tiltable and/or laterally movable with respect to its shank, or in constructions in which the bit body and the shank are rigidly connected together or formed integral with one another.

It will be appreciated that a plurality of the above described tiltable assemblies can be incorporated in a specific drill-string and drill bit application. For example a sub-assembly as illustrated in FIG. 12D can be incorporated in the drill string, e.g. between 1 and 3 ft. above the drill bit head in combination with at least one further tiltable assembly in accordance with the other described embodiments, disposed immediately above or incorporated in the drill bit.

The drill bits of the invention are less prone to vibration and can give improved benefits as described above; these benefits can be shown in use. For many purposes however it is desirable to be able to test bits in the laboratory and hitherto such testing was done there with apparatus comprising a rigid bit, short drill string or collar and motor. But we have found that drilling characteristics observed with such laboratory apparatus did not often parallel those found down hole, so that the bits broke more often down hole than was predicted from the tests. We have invented a laboratory drilling apparatus which can more closely create types of observed down hole phenomena.

The present invention provides a laboratory apparatus for simulating drilling which comprises (a) at least one rigid rotatable body connected directly or indirectly to each of (b) a drill bit for contacting a simulated bottom hole surface, and (c) means for rotating said body and bit, wherein at least one of (a) and (b), and (a) and (c), and (a) and another (a) when present, is separated by a flexible connector.

This apparatus can be capable of creating a large range of dynamic phenomena found in the field. Each rigid rotatable body used need only weigh up to 10–20 kg for ease of handling.

In the apparatus the rigid rotatable body simulates part or all of the drill string. The body is usually a cylinder, and made of steel, or other materials e.g. other metals such as aluminium or thermoset synthetic material or tungsten carbide, if it is desired to alter the inertia of the body. The bodies have connecting means e.g. threads at each end and usually an inner passage through them for fluid or gas.

The apparatus also comprises at least one flexible connector joining the rotating means to the rigid rotatable body and/or that body to the bit and/or one rigid rotatable body to another rigid rotatable body. Preferably there is a separate flexible connector between the rotating means and the body, and each body to the next body and the last body to the bit. To the last body, a bit can be rigidly or flexibly connected, depending upon which situation is investigated. When a reference situation has been created, either with a rigid or flexible bit, bit designs and particularly the properties of the scaled flexible connector can be studied. The properties of the bit so obtained in the laboratory can be related to the actual bit.

Each flexible connector can be adhered to the body, rotating means or bit, but preferably is connected to it by a screw thread. Each connector therefore preferably has an outwardly extending thread on each face of a pair of opposing radial faces adapted to engage threads on the body, rotating means or bit; conveniently a pair of plates each having thread extending axially therefrom is spaced apart by an elastomeric material in the form of a layered body. The layered body may if desired be adhered together or alternatively may be kept together with a pin or bolt between the plates which still enables the layered body to flex in a transverse direction. It is also possible to have one or more internal plates separating elastomeric bodies in a multi-layer structure, the elastomeric bodies being, if desired, of different compression modulus. The elastomeric material may be as described above.

The other essential ingredients in the apparatus are the rotating means e.g. an electric motor, especially of variable speed, and also the bit, whose design is being tested.

In use the bit bears upon a test piece of material to be drilled. In order to vary the angle of contact of bit on the piece and to simulate borehole constraint, the rigid rotatable bodies preferably pass through a simulated borehole wall. This wall may comprise rings, especially a series of rings defining a path in which the rigid bodies rotate, to create a simulated well bore profile. These rings may vary in inner diameter, outer diameter, height, mass, rigidity, inner surface friction coefficient, and may be made of different materials e.g. steel, concrete, synthetic polymer, whether thermoplastic thermoset or elastomeric, or rock. Alternatively to the rings there may be used a number of facially touching tiles made e.g. from rock, concrete, synthetic polymer, compositions comprising concrete, polymer, metal, sand or sand with polymer; a hole can be drilled through the tiles to provide the simulated borehole.

The test piece upon which the bit acts, is the simulated bottom hole material which may comprise natural rock, concrete, or compositions comprising these or sand or metal powder. Simulated rock of variable physical characteristics may be made from mixtures of clay and granular material e.g. sand, silicate or carbonate in different proportions and with different degrees of compaction.

The whole test apparatus may be 1–15 m high, conveniently 1–4 m high, with the rigid cylinders of 50–500 mm long and 2–200 mm wide such as ones 300 mm long with diameters of e.g. 5, 10 or 100 mm. Flexible connectors may be 10–60 mm long and of 5–100 e.g. 10–90 mm diameter. The apparatus preferably has at least one of its natural frequencies (axial and torsional) not greater than 10 to 5 Hz, e.g. 0.05–10 Hz, such as not greater than 1 Hz. The apparatus may be wall mounted or mounted in a frame, which may be portable. The rigid bodies (a) drill bit (b) and rotation means (c) with the flexible connector(s) of the invention can have an equivalent ratio of stiffness to mass of at most 1000 $sec^{-2}$ e.g. 100–0.01 $sec^{-2}$ especially 60–0.1 $sec^{-2}$.

If desired the apparatus may also include means for passing fluid e.g. water or gel around the bottom hole assembly or down the central drilling passage of the cylinders and flexible connectors.

The laboratory apparatus of the invention may be able to create at the bit conditions more realistic to those experienced by bits down hole than we have found possible with previous laboratory drilling apparatus with very rigid shafts and no flexible connectors. Thus it has often been found, that, with bits tested in such apparatus, the bits break more easily down hole (i.e. had a shorter life) than predicted from the laboratory apparatus results. Thus the apparatus of the present invention can be used to provide an improved method of testing a drill bit. Furthermore the rings or plates of other materials defining simulated bore hole walls can be moved relative to one another to create different degrees of bore hole interaction to study the effect of the changes on the dynamic behaviour of the bit.

Figures 21, 22:
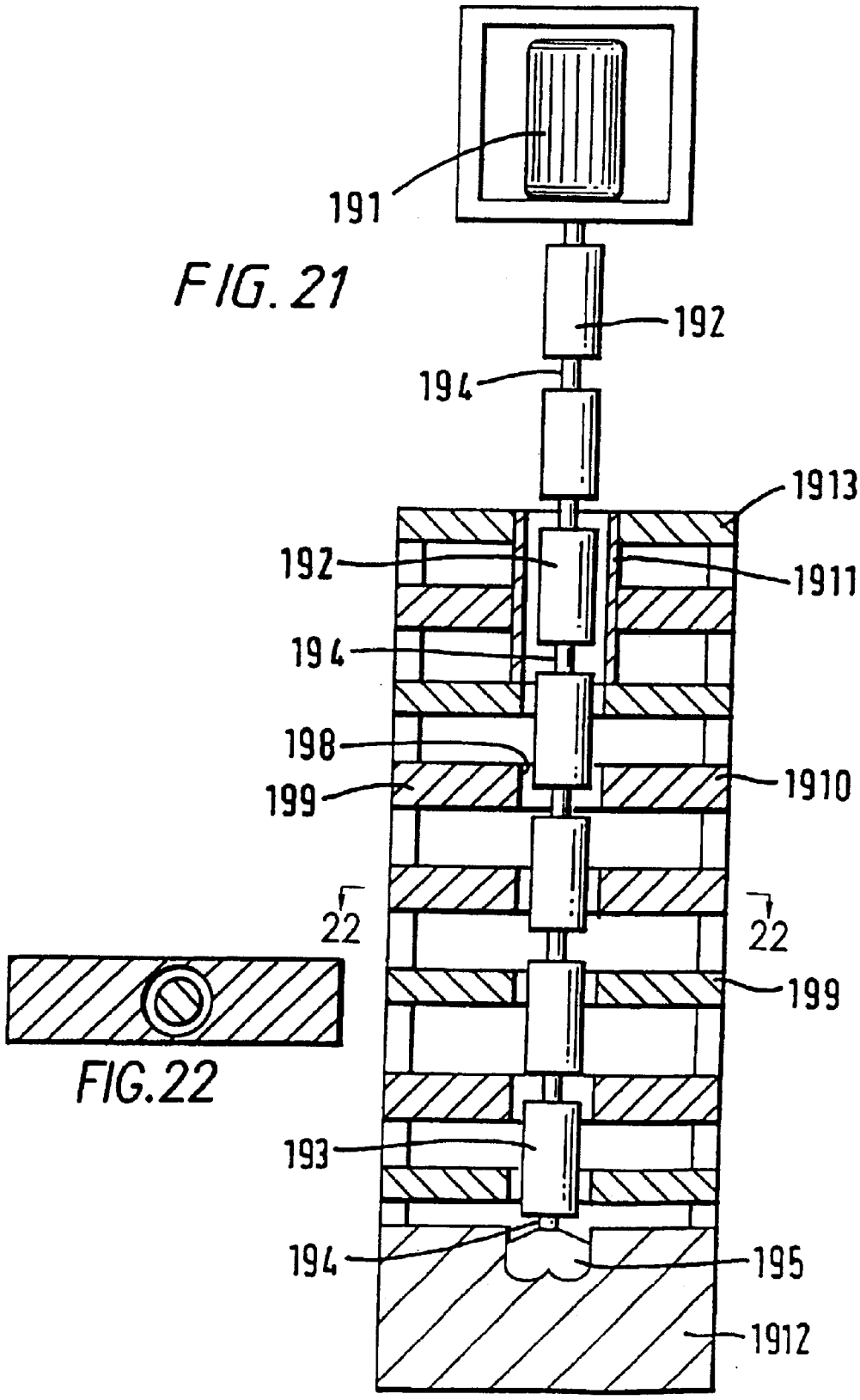
FIGS. 21 and 22 are respectively a schematic representation in longitudinal section of a test apparatus in accordance with the invention and a schematic detail of the drilling bit section of the apparatus, with FIG. 21A being a section along line A–A in FIG. 21.

This aspect of the invention is illustrated in FIGS. 21 and 22, in which FIG. 21 represents a schematic drawing of a complete testing apparatus and FIG. 22 represents a schematic section through a bit for use in that apparatus during construction.

Referring to FIG. 21, the apparatus has a motor 191, e.g. AC non-synchronous electric motor or a controlled DC electric motor, which drives a series of rigid cylinders 192 and 193 which are themselves joined together by flexible connectors 194. Attached to the lowest cylinder 193 is a further flexible connector 194, in turn attached to a bit 195, each of the connector 194 and bit 195 can independently be rigid or flexible. The rigid cylinders 192, connectors 194 and bit 195 have a continuous bore through them (not shown) to allow passage of a drilling fluid. The rigid cylinders 192 and 193 are constrained to rotate through bores 198 in plates 199, which may be single ones e.g. a metal ring or a series of plates 1910 which may be tiles or other sheets simply lain on top of one another or laminated together. Bores 198 simulate the bore hole passing through rocks and provide confinement to the string. Bores 198 may be an angle to vertical to simulate non-vertical drilling and the angle may be different in the location of different rotatable bodies to simulate a curved bore hole profile. At the top of the assembly of rigid cylinders 192 and 193 and connectors 194, two cylinders 192 and a connector 194 are located inside a pipe 1911 even more closely to simulate the casing and frictional effects therein. The bit 195 is in contact with a test piece 1912 being drilled. Test piece 1912 and the plates 199 are mounted in a frame 1913; the motor 191 may also be mounted on the frame 1913, or other beam support or separately supported e.g. on a wall, in both cases being mounted either rigidly or with freedom of axial movement. The whole assembly may be 1.5, 3, 5 or 10 m high. The cylinders may be 1–10 kg, may be of ferrous metal e.g. steel and can be conveniently of 300 mm length and 5, 10 or 100 mm width. The flexible connectors 194 usually have two metal plates separated by an elastomeric body and each plate usually has connection means e.g. an outwardly directed thread for joining to cylinders 192 and 193 or bit 195; the connector has a bore through it for the fluid. If desired the elastomeric body may be replaced by a spring.

If desired the cylinders 192 and/or 193 may contain sensors or other measurement equipment. The combination of inertia of the cylinders and flexibility of the connectors can be adjusted to provide a simulated drill string of vibration frequency of e.g. 0.2 Hz, usually similar to that of a drill string which may have variable length but is usually several kilometers long.

FIG. 22 shows a cylinder 201 of inner diameter corresponding to the bit diameter for the apparatus. Inside cylinder 201 are a series of blades 202, made e.g. of metal or from hard synthetic plastic e.g. thermoset resin, and especially with an elongate section 203 and a sharply curved section 204 (like a field hockey stick). The blades 202 are lightly glued in place to provide a bit with a known profile. The cylinder 201 is partly filled with moulding clay 205 or other inert malleable material so the blades 202 project partly above the clay. A shank 206 carrying a connecting thread 207 is located on the longitudinal axis of the cylinder. Between the clay 205 and shank 206 is set resin 208. The whole assembly apart from the cylinder and the moulding clay constitutes a small scale bit, which bit can be assembled in the above order with settable resin added last; once the resin has set the bit can be removed from the cylinder 201 and cleaned to remove the clay, thereby revealing the blades 202 embedded in cured resin 208 in a bit. If desired the shank 206 or cured resin 208 may be drilled to provide fluid channels for cleaning the bit.

When using the test apparatus of FIGS. 21 and 22, various parameters and dimensions of the apparatus can be specifically selected to reproduce actual conditions of a particular field site to be investigated. The test using the apparatus can then accurately simulate drilling conditions at that test site so that characteristics of the drilling apparatus, e.g. an apparatus in accordance with the invention, and/or other downhole devices can be optimized, e.g. the design and profile of the drilling bit. Once this is achieved, it is then only necessary to scale up the selected equipment design thereby achieving a faster field optimization of such design. The apparatus can also be used to specify the running procedure of that downhole equipment.

What is claimed is:

1. An apparatus for use in a drill string and drill bit assembly, comprising:

a first member for attachment to the drill string;

a second member comprising a drilling member; and a resiliently deformable spacer axially and laterally intermediate said first and second member for transmitting torque and weight between said first and second member, said spacer disposed between said first and second members so as to be compressed to allow tilting of or lateral movement of said first member relative to said second member under an applied load to enable more stable operation of the drilling member.

2. The apparatus as defined in claim 1, wherein the first member is a drive shank of a drill bit and the second member is a drill bit body.

3. The apparatus as defined in claim 2, further comprising at least one cutter movably mounted on the drill bit body.

4. The apparatus as defined in claim 3, wherein the cutter is adhered to the drill bit body by an elastomeric spacer.

5. The apparatus as defined in claim 1, wherein said first member is a drill bit body and second member is comprised of at least one drill cutter movably mounted on the drill bit body.

6. The apparatus as defined in claim 1, further comprising:

a non-resilient transfer member for transferring torque and weight from the first member through the spacer to the second member.

7. The apparatus as defined in claim 6, wherein the transfer member includes at least one elongate member passing through the second member and engaging at least one recess in the first member.

8. The apparatus as defined in claim 6, wherein the transfer member includes a plurality of recesses in one of the first and second members for engaging corresponding gear components in the other of the first and second members.

9. The apparatus as defined in claim 8, wherein the transfer member includes a threaded locking ring surrounding the first member and engaging threads on the second member.

10. The apparatus as defined in claim 1, wherein the spacer includes an elastomeric spacer extending between at least part of the first member and the second member.

11. The apparatus as defined in claim 10, wherein the elastomeric spacer comprises a hydrogenated nitrile rubber having a Shore A hardness of at least 80.

12. The apparatus as defined in claim 10, wherein the elastomeric spacer comprises a layered body having at least one elastomeric material layer and at least one metal layer.

13. The apparatus as defined in claim 1, wherein the resilient spacer comprises a hollow body containing a compressible fluid.

14. The apparatus as defined in claim 13, wherein the hollow body transfers torque between the first member and the second member.

15. The apparatus as defined in claim 1, further comprising:

each of the first and second members having cooperating passageways therein; and a compressible seal for sealing engagement with the first member and the second member to prevent escape of fluid from the passageways in the first member and the second member.

16. The apparatus as defined in claim 15, further comprising:

a flexible pipe providing fluid communication between the passageways in the first member and the second member.

17. An assembly for incorporating along a drill string, comprising:

a first member including a drill string;

a second member including a drill member;

a transfer member for transmitting weight and torque between the first member and the second member through a resilient spacer, said transfer member extending axially and laterally between the first member and the second member permitting the first member to tilt with respect to the second member, and wherein the second member is connected to the first member in a free-floating relationship, allowing the second member to tilt and move laterally with respect to the first member under an applied load to the drill string.

18. The assembly as defined in claim 17, wherein the transfer member includes a series of radial teeth on the first member that loosely engage corresponding recesses in the second member, and wherein radial outer surfaces on the teeth and opposed base surfaces of the recesses are configured to allowing tilting of the first member with respect to the second member.

19. The assembly as defined in claim 18, wherein the second member is formed with a connecting means for attaching thereto of a drill bit.

20. An apparatus for simulating drilling, comprising:

at least one rigid rotatable body;

a drill bit for contacting a simulated bottom hole surface and connected to the rigid rotatable body;

a rotation member for rotating the rigid rotatable body and the drill bit; and a flexible connector separating at least one of a rigid rotatable body and the drill bit and the rotatable member and the drill bit.

21. An apparatus for use in a drill string and drill bit assembly, comprising:

a first member for attachment to the drill string;

a second member for attachment to at least one drilling member;

a resiliently deformable connecting member between the first member and the second member for allowing tilting the first member with respect to the second member while transmitting torque and weight from the first member to the second member, the second member being connected by the connecting member to the first member in a free-floating relationship, thereby allowing the second member to tilt and move laterally with respect to the first member in response to reaction forces experienced during use of a drill bit and wherein the connecting member includes an elastomeric spacer extending between at least part of the first member and the second member and wherein the elastomeric spacer comprises a layered body having at least one elastomeric material layer and at least one metal layer.

22. An apparatus for use in a drill string and drill bit assembly, comprising:

a first member for attachment to the drill string;

a second member for attachment to at least one drilling member;

a resiliently deformable connecting member between the first member and the second member for allowing tilting the first member with respect to the second member while transmitting torque and weight from the first member to the second member, the second member being connected by the connecting member to the first member in a free-floating relationship, thereby allowing the second member to tilt and move laterally with respect to the first member in response to reaction forces experienced during use of a drill bit and wherein the connecting member comprises a hollow body containing a compressible fluid.

23. The apparatus as defined in claim 22 wherein the hollow body transfers torque between the first member and the second member.

24. An apparatus for use in a drill string and drill bit assembly, comprising:

a first member for attachment to the drill string;

a second member comprising a drilling member;

a resiliently deformable spacer intermediate said first and second member for transmitting torque and weight between said first and second member, said spacer disposed between said first and second members so as to be compressed to allow tilting of or lateral movement of said first member relative to said second member under an applied load to enable more stable operation of the drilling member;

said spacer including an elastomeric spacer extending between at least part of the first member and the second member; and wherein the elastomeric spacer comprises a layered body having at least one elastomeric material layer and at least one metal layer.

25. An apparatus for use in a drill string and drill bit assembly, comprising:

a first member for attachment to the drill string;

a second member comprising a drilling member;

a resiliently deformable spacer intermediate said first and second member for transmitting torque and weight between said first and second member, said spacer disposed between said first and second members so as to be compressed to allow tilting of or lateral movement of said first member relative to said second member under an applied load to enable more stable operation of the drilling member; and wherein the resiliently deformable spacer comprises a hollow body containing a compressible fluid.

26. The apparatus as defined in claim 25, wherein the hollow body transfers torque between the first member and the second member.

27. An apparatus for use in a drill string and drill bit assembly, comprising:

a first member for attachment to the drill string;

a second member comprising a drilling member;

a resiliently deform able spacer intermediate said first and second member for transmitting torque and weight between said first and second member, said spacer disposed between said first and second members so as to be compressed to allow tilting of or lateral movement of said first member relative to said second member under an applied load to enable more stable operation of the drilling member;

each of the first and second members having cooperating passageways therein; and a compressible seal for sealing engagement with the first member and the second member to prevent escape of fluid from the passageways in the first member and the second member.

28. The apparatus as defined in claim 27, further comprising:

a flexible pipe providing fluid communication between the passageways in the first member and the second member.

29. An apparatus for use in a drill string and drill bit assembly, comprising:

a first member for attachment to the drill string;

a second member comprising a drilling member;

a resiliently deformable spacer intermediate said first and second member for transmitting torque and weight between said first and second member, said spacer disposed between said first and second members so as to be compressed to allow tilting of or lateral movement of said first member relative to said second member under an applied load to enable more stable operation of the drilling member;

wherein the first member is a drive shank of a drill bit and the second member is a drill bit body;

at least one cutter movably mounted on the drill bit body; and wherein the cutter is adhered to the drill bit body by an elastomeric spacer.

* * * * *